US006713244B2

(12) United States Patent
Yamashita

(10) Patent No.: US 6,713,244 B2
(45) Date of Patent: Mar. 30, 2004

(54) SILVER HALIDE EMULSION

(75) Inventor: Seiji Yamashita, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/397,229

(22) Filed: Mar. 27, 2003

(65) Prior Publication Data

US 2003/0194666 A1 Oct. 16, 2003

(30) Foreign Application Priority Data

Mar. 28, 2002 (JP) ..... P. 2002-091755

(51) Int. Cl.[7] ..... G03C 1/035
(52) U.S. Cl. ..... 430/567

(58) Field of Search ..... 430/567

(56) References Cited

U.S. PATENT DOCUMENTS

| | | | |
|---|---|---|---|
| 4,094,684 | A | 6/1978 | Maskasky |
| 4,459,353 | A | 7/1984 | Maskasky |
| 5,747,235 | A | 5/1998 | Farid et al. |
| 6,300,044 | B1 | 10/2001 | Uytterhoeven et al. |

*Primary Examiner*—Hoa Van Le
(74) *Attorney, Agent, or Firm*—Sughrue Mion, PLLC

(57) ABSTRACT

A silver halide emulsion comprising a silver halide grain having a high silver iodide-containing phase, the surface of the silver halide grain being adsorbed with a substance capable of reducing by 50% or more the light emission intensity at 460 nm attributable to the high silver iodide-containing phase at 77° K.

6 Claims, No Drawings

SILVER HALIDE EMULSION

FIELD OF THE INVENTION

The present invention relates to a silver halide emulsion comprising high silver iodide and a photographic light-sensitive material using the emulsion.

BACKGROUND OF THE INVENTION

Silver iodide is a directive transition type and as compared with silver chloride and silver bromide which are an indirect transition type, this silver halide crystal has a large light absorption coefficient in the blue exposure region but also has a high recombination probability and therefore, high sensitization thereof is difficult. Because of this reason, a grain having a high silver iodide content of 90 mol % or more or a silver halide emulsion containing a region having a high silver iodide content is scarcely used in a photographic light-sensitive material, despite large light absorption in the blue region.

SUMMARY OF THE INVENTION

An object of the present invention is to attain high sensitization of a high silver iodide-containing silver halide emulsion which has large light absorption but is difficult of high sensitization.

(1) A silver halide emulsion comprising a silver halide grain having a high silver iodide-containing phase, the surface of the silver halide grain being adsorbed with a substance capable of reducing by 50% or more the light emission intensity at 460 nm attributable to the high silver iodide-containing phase at 77° K.

(2) The silver halide emulsion as described in (1), wherein the grain surface is adsorbed with an adsorbing substance capable of reducing by 70% or more the light emission intensity at 460 nm.

(3) The silver halide emulsion as described in (1) or (2), wherein a silver iodide content of the high silver iodide-containing phase is 93 mol % or more.

(4) The silver halide emulsion as described in any one of (1) to (3), wherein the silver halide grain comprises a hexacyano metal complex.

(5) A silver halide photographic light-sensitive material comprising the silver halide emulsion described in any one of (1) to (4).

(6) A heat-developable photographic light-sensitive material comprising the silver halide emulsion described in any one of (1) to (4).

DETAILED DESCRIPTION OF THE INVENTION

The present invention is described in detail below.

The high iodide silver halide emulsion of the present invention is described below.

The light-sensitive silver halide for use in the present invention may have a halogen composition of silver iodobromide, silver iodochlorobromide or silver iodide. Among these, silver iodide and silver iodobromide are preferred. However, if a region having a silver iodide content of 90 mol % or more (high silver iodide-containing phase, hereinafter also called a high silver iodide phase) is not present in the grain, the effect of the present invention cannot be satisfactorily obtained. The high silver iodide phase preferably occupies at least 10 mol % or more, more preferably 60 mol % or more, based on the silver halide in the grain as a whole. The silver iodide content of the high silver iodide phase is preferably from 93 to 100 mol %. The halogen composition distribution in the grain may be uniform (namely, the grain as a whole is a high silver iodide phase and this is called a high silver iodide grain), or the halogen composition may be changed stepwise or continuously. Also, a silver halide grain having a core/shell structure is preferably used. The structure of the core/shell grain is preferably a 2- to 5-ply structure, more preferably a 2- to 3-ply structure.

The size of the high silver iodide grain or high silver iodide phase is preferably small or thin so as to bring out the effect of the present invention and specifically, the size is preferably 0.20 $\mu$m or less, more preferably from 0.01 to 0.15 $\mu$m, still more preferably from 0.01 to 0.05 $\mu$m. The size of the grain as used herein means a diameter of a circular image having the same area as the projected area of a silver halide grain (in the case of a tabular grin, the projected area of the main plane). The size of the high silver iodide phase means a thickness of the platy phase when the high silver iodide phase is formed on a tabular grin, or a thickness of the shell when the high silver iodide phase is formed on a cubic grain, an octahedral grain, a tetradecahedral grain or the like.

The light emission at 460 nm of the high silver iodide phase at 77° K of the present invention is described below.

The 77° K can be specifically realized by dipping the emulsion in liquid nitrogen. The light emission may be measured using a direct transition absorption band of high silver iodide at 300 to 400 nm by a fluorescent measuring apparatus, however, in the present invention, this is defined as the light emission when light is excited as monochromatic light of 355 nm. More specifically, a light emission intensity at 460 nm with excited light of 355 nm is detected using a spectral fluorescence photometer Model 850 manufactured by Hitachi, Ltd., where only a monochromatizing filter peculiar to the apparatus is equipped in the excited light side, a band pass filter of transmitting light at 400 nm or more is equipped in the fluorescence detection side, and the light emission intensity in the wavelength range from 400 to 600 nm is measured at a sweeping rate of 60 nm/min. The decrease of the light emission quantity sometimes depends on the quantity of excited light absorbed. Accordingly, the light emission quantity used in the present invention is defined as a light emission quantity in the case of exciting a high silver iodide emulsion corresponding to 1.5 g/m$^2$ in terms of silver under the above-described conditions with a decrease percentage occurred when fluorescence intensity is measured in the range from 400 to 600 nm at a sweeping rate of 60 nm/sec using the above-described apparatus.

The sample must be carefully prevented from being irradiated with light until the measurement of fluorescence is started.

The compound capable of decreasing the light emission intensity for use in the present invention is described below.

Specific examples of the compound capable of decreasing the light emission intensity for use in the present invention include those described below, however, the present invention is not limited thereto. The important matter is that the compound can reduce the light emission intensity to 50% or less. Depending on the high iodide silver halide emulsion selected, the light emission intensity may not decrease to 50% or less. For example, unless the amount of the compound adsorbed to a grain is sufficiently large, the light emission intensity cannot be decreased, however, as is well known, the amount adsorbed is affected by the combination use with other photographically useful compounds and by the shape and composition of grain and therefore, even if the compound is decided, this does not always lead to the effect of the present invention. Furthermore, as described above with respect to the preferred grain size, if the grain size is large, the emulsion of the present invention is difficult to prepare. In order to sensitize the grain to a sufficiently high level of photographic light sensitivity, it is important to decrease the light emission intensity at 77° K to 50% or less and for more enhancing the preferred effect, to 70% or less. As the light emission intensity more decreases, a higher effect is obtained.

[Specific Examples of Preferred Compounds]

1) An FED sensitizer (fragmentable electron donating sensitizer) which generates two electrons with one photon is preferably contained. Preferred examples of the FED sensitizer include the compounds described in U.S. Pat. Nos. 5,747,235, 5,747,236, 6,054,260 and 5,994,051 and JP-A-2002-287293. As for the step of adding the FED sensitizer, any step in the process of producing a light-sensitive emulsion from the crystal growth until the preparation step immediately before coating is preferably used. The amount added varies depending on various conditions but is, as a guide, from $10^{-5}$ to $10^{-1}$ mol, preferably from $10^{-4}$ to $5\times10^{-2}$ mol, per mol of silver halide.

2) The pAg of the emulsion is preferably kept at 5.0 or less. In this case, the substance adsorbed to the grain surface is silver ion. If the pAg is 6.0 or more, almost no effect is provided, whereas if the pAg is 3.0 or less, the fogging is hardly controlled. The pAg is preferably from 3.5 to 5.0.

3) An organic compound where the highest occupied molecular orbital is nobler than +1.0 V and the lowest unoccupied molecular orbital is nobler than −1.4 V is preferably used. Some sensitizing dyes come under this category. Those of forming a J-aggregate are sometimes preferred.

4) In some cases, the emulsion of the present invention can be formed by imparting $10^{-4.5}$ mol or more of a tellurium sensitization nucleus per mol of silver halide. However, there is no meaning if fogged, therefore, the amount of the sensitizer used is restricted. The amount of the sensitizer used is preferably from $10^{-4}$ to $10^{-3}$ mol.

These are examples of the compounds. A combination use of two or more thereof, such as a combination use of the FED sensitizer and the dye, is preferred. However, the present invention is not limited thereto.

The method for forming a light-sensitive silver halide is well known in the art and, for example, the methods described in *Research Disclosure*, No. 17029 (June, 1978) and U.S. Pat. No. 3,700,458 can be used. Specifically, a method of adding a silver supply compound and a halogen supply compound to a gelatin or other polymer solution to prepare a light-sensitive silver halide and, if desired, then mixing it with an organic silver salt is used. In addition, the methods described in JP-A-11-119374 (the term "JP-A" as used herein means an "unexamined published Japanese patent application") (paragraphs 0217 to 0224), JP-A-11-352627 and JP-A-2000-347335 are also preferred.

Examples of the shape of the silver halide grain include a cubic grain, an octahedral grain, a tabular grain, a spherical grain, a rod-like grain and a potato-like grain. A silver halide grain with corners being rounded may also be preferably used. The high silver iodide phase may have either a β-AgI type crystal form or a γ-AgI type crystal form. The plane index (Miller index) on the outer surface of the light-sensitive silver halide grain is not particularly limited but a plane having a high spectral sensitization efficiency when a spectral sensitizing dye is adsorbed preferably occupies a larger percentage.

In the present invention, a silver halide grain where a hexacyano metal complex is present on the outermost surface of the grain is preferred. Examples of the hexacyano metal complex include $[Fe(CN)_6]^{4-}$, $[Fe(CN)_6]^{-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the present invention, a hexacyano Fe complex is preferred.

The hexacyano metal complex is present in the form of ion in an aqueous solution and therefore, the counter cation is not important but a cation readily miscible with water and having adaptability for the operation of precipitating the silver halide emulsion is preferably used and examples thereof include an alkali metal ion (e.g., sodium ion, potassium ion, rubidium ion, cesium ion, lithium ion), an ammonium ion and an alkylammonium ion (e.g., tetramethylammonium ion, tetraethylammonium ion, tetrapropylammonium ion, tetra(n-butyl)ammonium ion).

The hexacyano metal complex can be added after mixing it with water, with a mixed solvent of water and an appropriate water-miscible organic solvent (e.g., alcohols, ethers, glycols, ketones, esters, amides) or with gelatin.

The amount of the hexacyano metal complex added is preferably from $1\times10^{-5}$ to $1\times10^{-1}$ mol, more preferably from $1\times10^{-4}$ to $1\times10^{-2}$ mol, per mol of silver.

In order to allow the hexacyano metal complex to be present on the outermost surface of the silver halide grain, a hexacyano metal complex is directly added in the preparation step from after the completion of addition of an aqueous silver nitrate solution for the grain formation until before the chemical sensitization step of performing chalcogen sensitization such as sulfur sensitization, selenium sensitization and tellurium sensitization or noble metal sensitization such as gold sensitization, during the water washing step, during the dispersion step, or during the chemical sensitization step. For preventing the growth of the silver halide fine grain, the hexacyano metal complex is preferably added without delay after the grain formation and preferably before the completion of the preparation step.

The addition of the hexacyano metal complex may be started after 96 weight % of the total amount of silver nitrate for the grain formation is added, preferably 98 weight % is added, still more preferably 99 weight % is added.

When the hexacyano metal complex is added after an aqueous silver nitrate solution is added immediately before the completion of grain formation, the hexacyano metal complex can adsorb to the outermost surface of the silver halide grain and mostly forms a sparingly soluble salt with the silver ion on the grain surface. The silver salt of hexacynoiron(II) is a more sparingly soluble salt than AgI and therefore, can be prevented from redissolution due to fine grain and a silver halide grain having a small grain size can be produced.

The light-sensitive silver halide grain of the present invention can contain a metal of Groups 8 to 10 of the periodic table (showing from Group 1 to Group 18) or a complex thereof. The metal of Groups 8 to 10 of the periodic table or the center metal of the metal complex is preferably rhodium, ruthenium or iridium. One metal complex may be used or two or more complexes of same metal or different metals may be used in combination. The content thereof is preferably from $1\times10^{-9}$ to $1\times10^{-3}$ mol per mol of silver. The heavy metals, metal complexes and addition method thereof are described in JP-A-7-225449, JP-A-11-65021 (paragraphs 0018 to 0024) and JP-A-11-119374 (paragraphs 0227 to 0240). In the present invention, a 4-coordination metal complex can be preferably used.

Also, the metal atom (for example, $[Fe(CN)_6]^{4-}$) which can be contained in the silver halide grain for use in the present invention, and the desalting method and chemical sensitization method of the silver halide emulsion are described in JP-A-11-84574 (paragraphs 0046 to 0050), JP-A-11-65021 (paragraphs 0025 to 0031) and JP-A-11-119374 (paragraphs 0242 to 0250).

For the gelatin contained in the light-sensitive silver halide emulsion of the present invention, various gelatins can be used. A gelatin having a molecular weight of 10,000 to 1,000,000 is preferably used. It is also preferred that a substituent of gelatin is subjected to phthalation. The gelatin may be used during the grain formation or at the dispersion after desalting but is preferably used during the grain formation.

The sensitizing dye which can be used in the present invention is preferably selected from sensitizing dyes capable of spectrally sensitizing a silver halide grain in a desired wavelength region when adsorbed to the silver halide grain and having spectral sensitivity suitable for the spectral characteristics of the exposure light source. The sensitizing dye and the addition method thereof are described in JP-A-11-65021 (paragraphs 0103 to 0109), JP-A-10-186572 (compounds represented by formula (II)), JP-A-11-119374 (dyes represented by formula (I) and paragraph 0106), U.S. Pat. No. 5,510,236, U.S. Pat. No. 3,871,887 (dye described in Example 5), JP-A-2-96131, JP-A-59-48753 (dyes disclosed therein), EP-A-0803764 (from page 19, line 38 to page 20, line 35), JP-A-2001-272747, JP-A-2001-290234 and JP-A-2002-23306. The sensitizing dyes may be used individually or in combination of two or more thereof. In the present invention, the timing of adding the sensitizing dye in the silver halide emulsion is preferably in the time period after desalting until coating, more preferably after desalting until the completion of chemical ripening. The sensitizing dye for use in the present invention may be added in a desired amount according to the performance such as sensitivity and fog but the amount of the sensitizing dye added is preferably from $10^{-8}$ to 1 mol, more preferably from $10^{-4}$ to $10^{-1}$, per mol of silver halide in the light-sensitive layer.

In the present invention, in order to enhance the spectral sensitization efficiency, a supersensitizer may be used. Examples of the supersensitizer for use in the present invention include the compounds described in EP-A-587338, U.S. Pat. Nos. 3,877,943 and 4,873,184, JP-A-5-341432, JP-A-11-109547 and JP-A-10-111543.

The light-sensitive silver halide grain for use in the present invention is preferably subjected to chemical sensitization by chalcogen sensitization, for example, sulfur sensitization, selenium sensitization or tellurium sensitization. As for the compounds which are preferably used in the sulfur sensitization, selenium sensitization and tellurium sensitization, known compounds such as compounds described in JP-A-7-128768 can be used. In the present invention, tellurium sensitization is preferred and compounds described in JP-A-11-65021 (paragraph 0030) and compounds represented by formulae (II), (III) and (IV) of JP-A-5-313284 are more preferred.

The light-sensitive silver halide grain for use in the present invention is preferably subjected to chemical sensitization by gold sensitization alone or in combination with the above-described chalcogen sensitization. The gold sensitizer preferably has a gold valence number of +1 or +3 and gold compounds commonly used as the gold sensitizer are preferably used. Representative examples thereof include chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyltrichlorogold. Also, gold sensitizers described in U.S. Pat. No. 5,858,637 and JP-A-2002-278016 are preferably used.

In the present invention, the chemical sensitization may be performed at any step if it is after the grain formation and before the coating. After the desalting, the chemical sensitization may be performed, for example, (1) before spectral sensitization, (2) simultaneously with spectral sensitization, (3) after spectral sensitization or (4) immediately before coating. In the present invention, the amount of sulfur, selenium and tellurium sensitizers used varies depending on the silver halide grain used, chemical ripening conditions and the like, but the amount used is from $10^{-8}$ to $10^{-2}$ mol, preferably on the order of $10^{-7}$ to $10^{-3}$ mol, per mol of silver halide. The amount of the gold sensitizer added varies depending on various conditions but is, as a guide, from $10^{-7}$ to $10^{-3}$ mol, preferably from $10^{-6}$ to $5\times10^{-4}$ mol, per mol of silver halide. In the present invention, the conditions for the chemical sensitization are not particularly limited but the pH is from 5 to 8, the pAg is from 6 to 11 and the temperature is approximately from 40 to 95° C.

In the silver halide emulsion of the present invention, a thiosulfonic acid compound may be added by the method described in EP-A-293917.

The light-sensitive silver halide grain for use in the present invention is preferably subjected to reduction sensitization. Specific preferred examples of the compound for the reduction sensitization include ascorbic acid and thiourea dioxide. In addition, stannous chloride, aminoiminomethanesulfinic acid, hydrazine derivatives, borane compounds, silane compounds, polyamine compounds and the like are preferably used. The reduction sensitizer may be added at any step in the process of producing a light-sensitive emulsion from the crystal growth until the preparation step immediately before coating. The reduction sensitization is preferably performed by ripening the emulsion while keeping the pH at 7 or more or the pAg at 8.3 or less. Also, the reduction sensitization is preferably performed by conducting a single addition of silver ion at some period of the grain formation.

In the light-sensitive material for use in the present invention, only one light-sensitive silver halide emulsion may be used or two or more emulsions (different, for example, in the average grain size, the halogen composition, the crystal habit or the chemical sensitization conditions) may be used in combination. By using a plurality of light-sensitive silver halide emulsions different in the sensitivity, gradation can be controlled. Examples of the technique thereon include those described in JP-A-57-119341, JP-A-53-106125, JP-A-47-3929, JP-A-48-55730, JP-A-46-5187, JP-A-50-73627 and JP-A-57-150841. The difference in sensitivity between respective emulsions is preferably 0.2 in terms of log E or more.

The silver halide emulsion of the present invention can be preferably used in a heat-development system. The heat-development system where the silver halide emulsion of the present invention is preferably used is described below.

The amount of the light-sensitive silver halide added is, in terms of the coated silver amount per $m^2$ of the light-sensitive material, preferably from 0.03 to 0.6 $g/m^2$, more preferably from 0.07 to 0.4 $g/m^2$, most preferably from 0.05 to 0.3 $g/m^2$. The amount of the light-sensitive silver halide added is, per mol of the organic silver salt, preferably from 0.01 to 0.5 mol, more preferably from 0.02 to 0.3 mol, still more preferably from 0.03 to 0.2 mol.

The method and conditions for the mixing of separately prepared light-sensitive silver halide and organic silver salt are not particularly limited insofar as the effect of the present invention is satisfactorily brought out but a method of mixing silver halide grain and organic silver salt, each after the completion of preparation, in a high-speed agitator, a ball mill, a sand mill, a colloid mill, a vibration mill, a homogenizer or the like, or a method of preparing an organic silver salt by mixing a light-sensitive silver halide of which preparation is completed, at any timing during the preparation of organic silver salt may be used. For controlling the photographic property, it is preferred to mix two or more aqueous dispersions of organic silver salt with two or more aqueous dispersions of light-sensitive silver salt.

In the present invention, the timing of adding the silver halide to a coating solution for the image-forming layer is preferably from 180 minutes before coating to immediately before coating, more preferably from 60 minutes to 10 seconds before coating, however, the mixing method and the mixing conditions are not particularly limited insofar as the effect of the present invention can be satisfactorily brought out. Specific examples of the mixing method include a method of mixing the silver halide with the solution in a tank designed to give a desired average residence time which is calculated from the addition flow rate and the amount of liquid fed to the coater, and a method using a static mixer described, for example, in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989).

(Description of Organic Silver Salt)

The organic silver salt which can be used in the present invention is a silver salt relatively stable to light but capable of functioning as a silver ion supply material to form a silver image when heated at 80° C. or more in the presence of an exposed light-sensitive silver halide and a reducing agent. The organic silver salt may be any organic substance capable of supplying a silver ion which can be reduced by a reducing agent. Such a light-insensitive organic silver salt is described in JP-A-10-62899 (paragraphs 0048 to 0049), EP-A-0803764 (page 18, line 24 to page 19, line 37), EP-A-0962812, JP-A-11-349591, JP-A-2000-7683 and JP-A-2000-72711. The organic silver salt is preferably a silver salt of an organic acid, particularly a silver salt of a long chain aliphatic carboxylic acid (having from 10 to 30 carbon atoms, preferably from 15 to 28 carbon atoms). Preferred examples of the fatty acid silver salt include silver lignocerate acid, silver behenate, silver arachidate, silver stearate, silver oleate, silver laurate, silver caproate, silver myristate, silver palmitate, silver erucate and mixtures thereof. Of these fatty acid silver salts, preferred in the present invention are fatty acid silver salts having a silver behenate content of 50 mol % or more, more preferably 85 mol % or more, still more preferably 95 mol % or more.

The shape of the organic silver salt which can be used in the present invention is not particularly limited and the organic silver salt may have any of needle form, rod-like form, tabular form and scaly form.

As for the production method of the organic silver salt used in the present invention and the dispersion method thereof, known methods can be employed. Examples thereof include the methods described in JP-A-10-62899, EP-A-0803763, EP-A-0962812, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2002-6442, JP-A-2002-31870 and JP-A-2002-107868.

When the light-sensitive silver salt is present together at the dispersion of organic silver salt, fog increases and sensitivity seriously decreases. Therefore, it is preferred to contain substantially no light-sensitive silver salt at the dispersion. In the present invention, the amount of the light-sensitive silver salt dispersed in a aqueous dispersion is preferably 1 mol % or less, more preferably 0.1 mol % or less, per mol of the organic silver salt in the dispersion. It is still more preferred that the light-sensitive silver salt is not added positively.

In the present invention, a light-sensitive material can be produced by mixing the organic silver salt aqueous dispersion and the light-sensitive silver salt aqueous dispersion and the mixing ratio of the organic silver salt to the light-sensitive silver salt can be selected according to the purpose, however, the ratio of the light-sensitive silver salt to the organic silver salt is preferably from 1 to 30 mol %, more preferably from 2 to 20 mol %, still more preferably from 3 to 15 mol %. A method of using two or more organic silver salt aqueous dispersions and two or more light-sensitive silver salt aqueous dispersions at the mixing is preferably employed for controlling the photographic properties.

In the present invention, the organic silver salt can be used in a desired amount but the amount added thereof is preferably, in terms of the total coated silver amount including silver halide, from 0.1 to 5.0 g/m$^2$, more preferably from 0.3 to 3.0 g/m$^2$, still more preferably from 0.5 to 2.0 g/m$^2$. Particularly, in order to enhance the image preservability, the total coated silver amount is preferably 1.8 g/m$^2$ or less, more preferably 1.6 g/m$^2$ or less. Using a reducing agent, a sufficiently high image density can be obtained with such a low silver amount.

(Description of Reducing Agent)

The heat-developable light-sensitive material of the present invention preferably contains a heat developer which is a reducing agent for the organic silver salt. The reducing agent for the organic silver salt may be any substance (preferably an organic substance) capable of reducing silver ion into metal silver. Examples of the reducing agent include those described in JP-A-11-65021 (paragraphs 0043 to 0045) and EP-A-0803764 (page 7, line 34 to page 18, line 12). In the present invention, the amount of the reducing agent added is preferably from 0.1 to 3.0 g/m$^2$, more preferably from 0.2 to 1.5 g/m$^2$, still more preferably from 0.3 to 1.0 g/m$^2$. The reducing agent is preferably contained in an amount of 5 to 50 mol %, more preferably from 8 to 30 mol %, still more preferably from 10 to 20 mol %, per mol of silver on the side having an image-forming layer. The reducing agent is preferably incorporated into the image-forming layer.

In adding the reducing agent to a coating solution and thereby incorporating it into the light-sensitive material, the reducing agent may be added in any form, for example, in the form of a solution, an emulsified dispersion or a solid fine particle dispersion. Well-known examples of the emulsification dispersion method include a method of dissolving the reducing agent using an oil such as dibutyl phthalate, tricresyl phosphate, glyceryl triacetate or diethyl phthalate, and an auxiliary solvent such as ethyl acetate or cyclohexanone, and mechanically forming an emulsified dispersion.

Examples of the solid fine particle dispersion method include a method of dispersing the reducing agent in the powder form in an appropriate solvent such as water using a ball mill, a colloid mill, a vibrating ball mill, a sand mill, a jet mill, a roller mill or an ultrasonic wave, thereby preparing a solid dispersion. At this time, a protective colloid (e.g., polyvinyl alcohol) or a surfactant (for example, an anionic surfactant such as sodium triisopropylnaphthalenesulfonate (a mixture of substances different in the substitution positions of three isopropyl groups)) may be used. In the above-described mills, beads such as zirconia are commonly used as a dispersion medium and Zr or the like dissolved out from these beads may be mixed in the dispersion. The content thereof is usually from 1 to 1,000 ppm, though it varies depending on the dispersing conditions. It does not cause a problem in practice if the content of Zr in the light-sensitive material is 0.5 mg or less per g of silver. In the aqueous dispersion, an antiseptic (e.g., benzoisothiazolinone sodium salt) is preferably added. In the present invention, the reducing agent is preferably used as a solid dispersion.

(Description of Development Accelerator)

The heat-developable light-sensitive material of the present invention uses a development accelerator and the development accelerator is preferably a sulfonamidophenol-base compound represented by formula (A), of JP-A-2000-267222 and JP-A-2000-330234, a hindered phenol-base compound represented by formula (II) of JP-A-2001-92075, a hydrazine-base compound represented by formula (I) of JP-A-10-62895 and JP-A-11-15116 or formula (1) of JP-A-2002-278017, or a phenol-base or naphthol-base compound represented by formula (2) of JP-A-2001-264929. The development accelerator is used in the range from 0.1 to 20 mol %, preferably from 0.5 to 10 mol %, more preferably from 1 to 5 mol %, based on the reducing agent. The development accelerator may be introduced into the light-sensitive material using the same methods as described above for the reducing agent but is preferably added as a solid dispersion or an emulsified dispersion. In the case of addition as an emulsified dispersion, the development accelerator is preferably added as an emulsified dispersion obtained using a high boiling point solvent which is a solid at an ordinary temperature and a low boiling point auxiliary solvent, or as a so-called oil-less emulsified dispersion using no high boiling point solvent.

Among the development accelerators, those more preferred in the present invention include the hydrazine-base compound represented by formula (1) of JP-A-2002-278017 and the phenol-base or naphthol-base compound represented by formula (2) of JP-A-2001-264929.

(Description of Hydrogen Bond-Forming Compound)

In the case where the reducing agent for use in the present invention has an aromatic hydroxyl group (—OH), particularly, in the case of a bisphenol described above, a non-reducing compound having a group capable of forming a hydrogen bond with the hydroxyl group is preferably used in combination. Examples of the group capable of forming a hydrogen bond with a hydroxyl group or amino group include a phosphoryl group, a sulfoxido group, a sulfonyl group, a carbonyl group, an amido group, an ester group, a urethane group, a ureido group, a tertiary amino group and a nitrogen-containing aromatic group. Among these, preferred are the compounds having a phosphoryl group, a sulfoxido group, an amido group (provided that this does not have a >N—H group and is blocked like >N—Ra (wherein Ra is a substituent except for H)), a urethane group (provided that this does not have a >N—H group and is blocked like >N—Ra (wherein Ra is a substituent except for H)) or a ureido group (provided that this does not have a >N—H group and is blocked like >N—Ra (wherein Ra is a substituent except for H)). Specific examples of the hydrogen bond-forming compound include, in addition to those described above, the compounds described in European Patent 1096310, JP-A-2002-156727 and JP-A-2002-318431.

(Description of Binder)

In the present invention, the binder used for the organic silver salt-containing layer may be any polymer and the suitable binder is transparent or translucent and generally colorless. Examples thereof include natural resins, polymers and copolymers, synthetic resins, polymers and copolymers, and film-forming mediums such as gelatins, rubbers, poly (vinyl alcohols), hydroxyethyl celluloses, cellulose acetates, cellulose acetate butyrates, poly(vinyl pyrrolidones), casein, starch, poly(acrylic acids), poly(methyl methacrylates), poly (vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal), poly(vinyl butyral)), poly(esters), poly (urethanes), phenoxy resin, poly(vinylidene chlorides), poly (epoxides), poly(carbonates), poly(vinyl acetates), poly (olefins), cellulose esters and poly(amides). The binder may also be coated and formed from water, an organic solvent or an emulsion.

In the present invention, the binder which can be used in the organic silver salt-containing layer preferably has a glass transition temperature of 10 to 80° C. (hereinafter sometimes referred to as a "high Tg binder"), more preferably from 15 to 70° C., still more preferably from 20 to 65° C. In the present invention, a polymer dispersible in an aqueous solvent is particularly preferred. Examples of the dispersed state include a latex where fine particles of a water-insoluble hydrophobic polymer are dispersed, and a case where polymer molecules are dispersed in the molecular state or by forming micelles. The polymer may be dispersed in either state but a latex where polymer fine particles are dispersed is more preferred. The average particle size of the dispersed particles is from 1 to 50,000 nm, preferably from 5 to 1,000 nm, more preferably from 10 to 500 nm, still more preferably from 50 to 200 nm. The particle size distribution of the dispersed particles is not particularly limited and the dispersed particles may have either a wide particle size distribution or a monodisperse particle size distribution. A method of using a mixture of two or more dispersions each having a monodisperse particle size distribution is also preferred in controlling the physical properties of the coating solution.

In the present invention, a preferred embodiment of the polymer dispersible in an aqueous solvent is a hydrophobic polymer such as acrylic polymers, poly(esters), rubbers (e.g., SBR resin), poly(urethanes), poly(vinyl chlorides), poly(vinyl acetates), poly(vinylidene chlorides) and poly (olefins). These polymers may be a linear, branched or crosslinked polymer and also may be a so-called homopolymer obtained by the polymerization of a single monomer or a copolymer obtained by the polymerization of two or more monomers. In the case of a copolymer, the copolymer may be a random copolymer or a block copolymer. The molecular weight of the polymer is, in terms of the number average molecular weight, from 5,000 to 1,000,000, preferably from 10,000 to 200,000. If the molecular weight is too small, the emulsion layer formed is insufficient in the mechanical strength, whereas if the molecular weight is excessively large, the film forming property is poor. A crosslinkable polymer latex is preferably used.

In particular, the polymer latex for use in the present invention is preferably a latex of styrene-butadiene copolymer. In the styrene-butadiene copolymer, the weight ratio between the styrene monomer unit and the butadiene monomer unit is preferably from 40:60 to 95:5. Furthermore, the styrene monomer unit and the butadiene monomer unit preferably occupy from 60 to 99 mass % of the copolymer.

Also, the polymer latex for use in the present invention preferably contains an acrylic or methacrylic acid in an amount of 1 to 6 weight %, more preferably from 2 to 5 weight %, based on the total of styrene and butadiene. The polymer latex for use in the present invention preferably contains an acrylic acid. Examples of the styrene-butadiene copolymer latex which is preferably used in the present invention include commercially available products such as LACSTAR-3307B, 7132C and Nipol Lx416.

The organic silver salt-containing layer of the light-sensitive material of the present invention may contain, if desired, a hydrophilic polymer such as gelatin, polyvinyl alcohol, methyl cellulose, hydroxypropyl cellulose and carboxymethyl cellulose. The amount of the hydrophilic polymer added is preferably 30 weight % or less, more preferably 20 weight % or less, based on the entire binder in the organic silver salt-containing layer.

The organic silver salt-containing layer (namely, image-forming layer) of the present invention is preferably formed using a polymer latex. The amount of the binder in the organic silver salt-containing layer is, in terms of a weight ratio of entire binder/organic silver salt, from 1/10 to 10/1, preferably from 1/3 to 5/1, more preferably from 1/1 to 3/1.

The organic silver salt-containing layer is usually also a light-sensitive layer (emulsion layer) containing a light-sensitive silver halide which is a light-sensitive silver salt. In this case, the weight ratio of entire binder/silver halide is preferably from 400/1 to 5/1, more preferably from 200/1 to 10/1.

In the present invention, the total binder amount of the image-forming layer is preferably from 0.2 to 30 g/m$^2$, more preferably from 1 to 15 g/m$^2$, still more preferably from 2 to 10 g/m$^2$. The image-forming layer for use in the present invention may contain a crosslinking agent for forming a crosslinked structure or a surfactant for improving the coatability.

(Preferred Solvent for Coating Solution)

In the present invention, the solvent (for the sake of simplicity, the solvent and the dispersion medium are collectively called a solvent) in the coating solution for the organic silver salt-containing layer of the light-sensitive material is preferably an aqueous solvent containing 30 weight % or more of water. As for the component other than water, an optional water-miscible organic solvent may be used, such as methyl alcohol, ethyl alcohol, isopropyl alcohol, methyl cellosolve, ethyl cellosolve, dimethylformamide and ethyl acetate. The solvent of the coating solution preferably has a water content of 50 weight % or more, more preferably 70 weight % or more. Examples of preferred solvent compositions include, in addition to water, water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (the numerals are weight %).

(Description of Antifoggant)

Examples of the antifoggant, stabilizer and stabilizer precursor which can be used in the present invention include those described in JP-A-10-62899 (paragraph 0070) and EP-A-0803764 (page 20, line 57 to page 21, line 7), and compounds described in JP-A-9-281637, JP-A-9-329864, U.S. Pat. No. 6,083,681 and European Patent 1048975. The antifoggant preferably used in the present invention is an organic halide and examples thereof include those disclosed in the patents cited in JP-A-11-65021 (paragraphs 0111 to 0112). In particular, organic halogen compounds represented by formula (P) of JP-A-2000-284399, organic polyhalogen compounds represented by formula (II) of JP-A-10-339934, and organic polyhalogen compounds described in JP-A-2001-31644 and JP-A-2001-33911 are preferred.

(Description of Polyhalogen Compound)

The organic polyhalogen compound preferably used in the present invention is specifically described below. The polyhalogen compound preferred in the present invention is a compound represented by the following formula (H):

$$Q—(Y)_n—C(Z_1)(Z_2)X \quad (H)$$

wherein Q represents an alkyl group, an aryl group or a heterocyclic group, Y represents a divalent linking group, n represents 0 or 1, $Z_1$ and $Z_2$ each represents a halogen atom and X represents a hydrogen atom or an electron-withdrawing group. In formula (H), Q is preferably an aryl group or a heterocyclic group. In formula (H), when Q is a heterocyclic group, the heterocyclic group is preferably a nitrogen-containing heterocyclic group having one or two nitrogen atoms, more preferably a 2-pyridyl group or a 2-quinolyl group. In formula (H), when Q is an aryl group, Q preferably represents a phenyl group substituted by an electron-withdrawing group having a Hammett's substituent constant σp of a positive value. Regarding the Hammett's substituent constant the descriptions, for example, in *Journal of Medicinal Chemistry*, Vol. 16, No. 11, 1207–1216 (1973) can be referred to. Examples of such an electron-withdrawing group include halogen atoms (e.g., fluorine (σp: 0.06), chlorine (σp: 0.23), bromine (σp: 0.23), iodine (σp: 0.18)), trihalomethyl groups (e.g., tribromomethyl (σp: 0.29), trichloromethyl (σp: 0.33), trifluoromethyl (σp: 0.54)), a cyano group (σp: 0.66), a nitro group (σp: 0.78), aliphatic, aryl or heterocyclic sulfonyl groups (e.g., methanesulfonyl (σp: 0.72)), aliphatic, aryl or heterocyclic acyl groups (e.g., acetyl (σp: 0.50), benzoyl (σp: 0.43)), alkynyl groups (e.g., —C≡CH (σp: 0.23)), aliphatic, aryl or heterocyclic oxycarbonyl groups (e.g., methoxycarbonyl (σp: 0.45), phenoxycarbonyl (σp: 0.44)), a carbamoyl group (σp: 0.36), a sulfamoyl group (σp: 0.57), a sulfoxide group, a heterocyclic group and a phosphoryl group. The σp value is preferably from 0.2 to 2.0, more preferably from 0.4 to 1.0. Among these electron-withdrawing groups, preferred are a carbamoyl group, an alkoxycarbonyl group, an alkylsulfonyl group and an alkylphosphoryl group, and most preferred is a carbamoyl group.

X is preferably an electron-withdrawing group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, still more preferably a halogen atom. Among the halogen atoms, preferred are chlorine, bromine and iodine, more preferred are chlorine and bromine, and still more preferred is bromine. Y preferably represents —C(=O)—, —SO— or —$SO_2$—, more preferably —C(=O)— or —$SO_2$—, still more preferably —$SO_2$—. n represents 0 or 1, preferably 1.

The compound represented by formula (H) of the present invention is preferably used in the range from $10^{-4}$ to 1 mol, more preferably from $10^{-3}$ to 0.5 mol, still more preferably from $1\times10^{-2}$ to 0.2 mol, per mol of the light-insensitive silver salt in the image-forming layer. In the present invention, for incorporating the antifoggant into the light-sensitive material, the methods described above for the incorporation of reducing agent may be used. The organic polyhalogen compound is also preferably added in the form of a solid fine particle dispersion.

(Other Antifoggants)

Other examples of the antifoggant include mercury(II) salts described in JP-A-11-65021 (paragraph 0113), benzoic acids described in the same patent publication (paragraph 0114), salicylic acid derivatives described in JP-A-2000-206642, formalin scavenger compounds represented by formula (S) of JP-A-2000-221634, triazine compounds according to claim 9 of JP-A-11-352624, compounds represented by formula (III) of JP-A-6-11791, and 4-hydroxy-6-methyl-1,3,3a,7-tetrazaindene.

For the purpose of preventing fogging, the heat-developable light-sensitive material of the present invention may contain an azolium salt. Examples of the azolium salt include compounds represented by formula (XI) of JP-A-59-193447, compounds described in JP-B-55-12581 (the term "JP-B" as used herein means an "examined Japanese patent publication"), and compounds represented by formula (II) of JP-A-60-153039.

In the present invention, a mercapto compound, a disulfide compound or a thione compound may be incorporated so as to control development by preventing or accelerating the development, enhance the spectral sensitization efficiency or improve the storability before or after the development. Examples of these compounds include compounds described in JP-A-10-62899 (paragraphs 0067 to 0069), compounds represented by formula (I) and specific examples thereof in paragraphs 0033 to 0052 of JP-A-10-186572, and compounds described in EP-A-0803764 (page 20, lines 36 to 56). Among these, mercapto-substituted heteroaromatic compounds described in JP-A-9-297367, JP-A-9-304875, JP-A-2001-100358, JP-A-2002-303954 and JP-A-2002-303951 are preferred.

(Description of Toning Agent)

A toning agent is preferably added to the heat-developable light-sensitive material of the present invention. Examples of the toning agent include those described in JP-A-10-62899 (paragraphs 0054 to 0055), EP-A-0803764 (page 21, lines 23 to 48), JP-A-2000-356317 and JP-A-2000-187298. Particularly preferred are phthalazinones (phthalazinone, phthalazinone derivatives, and metal salts of phthalazinone, e.g., 4-(1-naphthyl)phthalazinone, 6-chlorophthalazinone, 5,7-dimethoxyphthalazinone, 2,3-dihydro-1,4-phthalazinedione); combinations of a phthalazinone and a phthalic acid (e.g., phthalic acid, 4-methylphthalic acid, 4-nitrophthalic acid, diammonium phthalate, sodium phthalate, potassium phthalate, tetrachlorophthalic anhydride); phthalazines (phthalazine, phthalazine derivatives, and metal salts of phthalazine, e.g., 4-(1-naphthyl)phthalazine, 6-isopropylphthalazine, 6-tert-butylphthalazine, 6-chlorophthalazine, 5,7-dimethoxyphthalazine, 2,3-dihydrophthalazine); and combinations of a phthalazine and a phthalic acid. Among these, more preferred are combinations of a phthalazine and a phthalic acid, and still more preferred is a combination of 6-isopropylphthalazine and phthalic acid or 4-methylphthalic acid.

(Other Additives)

A plasticizer and lubricant which can be used in the light-sensitive layer of the present invention are described in JP-A-11-65021 (paragraph 0117); the ultrahigh contrast-providing agent for the formation of an ultrahigh contrast image and the addition method and amount added thereof are described in JP-A-11-65021 (paragraph 0118), JP-A-11-223898 (paragraphs 0136 to 0193), JP-A-2000-284399 (compounds represented by formula (H), formulae (1) to (3) and formulae (A) and (B)) and JP-A-2000-347345 (compounds represented by formulae (III) to (V), specific compounds of Chem. 21 to Chem. 24); and the ultrahigh contrast-promoting agent is described in JP-A-11-65021 (paragraph 0102) and JP-A-11-223898 (paragraphs 0194 to 0195).

In the case of using an ultrahigh contrast-providing agent in the heat-developable light-sensitive material of the present invention, an acid resulting from hydration of diphosphorus pentoxide or a salt thereof is preferably used in combination. Examples of the acid resulting from hydration of diphosphorus pentoxide, and the salt thereof include metaphosphoric acid (and salts thereof), pyrophosphoric acid (and salts thereof), orthophosphoric acid (and salts thereof), triphosphoric acid (and salts thereof), tetraphosphoric acid (and salts thereof) and hexametaphosphoric acid (and salts thereof). Particularly preferred are orthophosphoric acid (and salts thereof) and hexametaphosphoric acid (and salts thereof). Specific examples of the salt include sodium orthophosphate, sodium dihydrogenorthophosphate, sodium hexametaphosphate and ammonium hexametaphosphate. The amount used (coated amount per $m^2$ of the light-sensitive material) of the acid resulting from hydration of diphosphorus pentoxide or a salt thereof may be appropriately selected according to the performance such as sensitivity and fog but is preferably from 0.1 to 500 $mg/m^2$, more preferably from 0.5 to 100 $mg/m^2$.

(Description of Layer Structure)

In the heat-developable light-sensitive material of the present invention, a surface protective layer may be provided so as to prevent adhesion of the image-forming layer. The surface protective layer may be a single layer or may be composed of a plurality of layers. The surface protective layer is described in JP-A-11-65021 (paragraphs 0119 to 0120) and JP-A-2000-171936. In the present invention, the binder for the surface protective layer is preferably gelatin but polyvinyl alcohol (PVA) is also preferably used or used in combination with gelatin. Examples of the gelatin which can be used include inert gelatin (e.g., Nitta Gelatin 750) and phthalated gelatin (e.g., Nitta Gelatin 801). Examples of PVA include those described in JP-A-2000-171936 (paragraphs 0009 to 0020) and preferred examples thereof include completely saponified product PVA-105, partially saponified products PVA-205 and PVA-335, and modified polyvinyl alcohol MP-203 (trade names, produced by Kuraray Co., Ltd.). The coated amount (per $m^2$ of the support) of polyvinyl alcohol of the protective layer (per one layer) is preferably from 0.3 to 4.0 $g/m^2$, more preferably from 0.3 to 2.0 $g/m^2$.

Particularly, in the case of using the heat-developable light-sensitive material of the present invention for printing where the dimensional change becomes a problem, a polymer latex is preferably used for the surface protective layer or the back layer. The polymer latex for such a purpose is described in Taira Okuda and Hiroshi Inagaki (compilers), *Gosei Jushi Emulsion* (*Synthetic Resin Emulsion*), Kobunshi Kankokai (1978), Takaaki Sugimura, Yasuo Kataoka, Soichi Suzuki and Keishi Kasahara (compilers), *Gosei Latex no Oyo* (*Application of Synthetic Latex*), Kobunshi Kankokai (1993), and Soichi Muroi, *Gosei Latex no Kagaku* (*Chemistry of Synthetic Latex*), Kobunshi Kankokai (1970). Specific examples of the polymer latex include a latex of methyl methacrylate (33.5 weight %)/ethyl acrylate (50 weight %)/methacrylic acid (16.5 weight %) copolymer, a latex of methyl methacrylate (47.5 weight %)/butadiene (47.5 weight %)/itaconic acid (5 weight %) copolymer, a latex of ethyl acrylate/methacrylic acid copolymer, a latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer and a latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer. For the binder of the surface protective layer, techniques described in JP-A-2000-267226 (paragraphs 0021 to 0025) and JP-A-2000-19678 (paragraphs 0023 to 0041) may also be applied. The percentage of the polymer latex in the surface protective layer is preferably from 10 to 90 weight %, more preferably from 20 to 80 weight %, based on the entire binder. The coated amount (per $m^2$ of the support) of the entire binder (including water-soluble polymer and latex polymer) for the surface protective layer (per one layer) is preferably from 0.3 to 5.0 $g/m^2$, more preferably from 0.3 to 2.0 $g/m^2$.

In the present invention, the temperature at the preparation of a coating solution for the image-forming layer is preferably from 30 to 65° C., more preferably from 35 to less than 60° C., still more preferably from 35 to 55° C. Furthermore, the coating solution for the image-forming layer immediately after the addition of the polymer latex is preferably kept at a temperature of 30 to 65° C.

In the present invention, the image-forming layer is composed of one or more layers on the support. In the case where the image-forming layer is composed of a single layer, the layer comprises an organic silver salt, a light-sensitive silver halide, a reducing agent and a binder and if desired, additionally contains additional materials such as toning agent, coating aid and other adjuvants. In the case where the image-forming layer is composed of two or more layers, a first image-forming layer (usually a layer adjacent to the support) contains an organic silver salt and a light-sensitive silver halide, and a second image-forming layer or these two layers contain some other components. In the structure of a multicolor light-sensitive heat-developable photographic material, a combination of these two layers may be provided for each color or as described in U.S. Pat. No. 4,708,928, all the components may be contained in a single layer. In the case of a multi-dye multicolor light-sensitive heat-developable photographic material, the emulsion layers are held separately from each other by interposing a functional or nonfunctional barrier layer between respective light-sensitive layers, as described in U.S. Pat. No. 4,460,681.

In the present invention, the light-sensitive layer may contain various dyes or pigments (for example, C.I. Pigment Blue 60, C.I. Pigment Blue 64, C.I. Pigment Blue 15:6) from the standpoint of improving the color tone, inhibiting the generation of interference fringes on laser exposure or preventing the irradiation. These are described in detail in WO98/36322, JP-A-10-268465 and JP-A-11-338098.

In the heat-developable light-sensitive material of the present invention, an antihalation layer may be provided on the side farther from a light source with respect to the light-sensitive layer.

The heat-developable light-sensitive material ordinarily has a light-insensitive layer in addition to the light-sensitive layer. The light-insensitive layer can be classified by its position into (1) a protective layer provided on a light-sensitive layer (on the side farther from the support), (2) an interlayer provided between a plurality of light-sensitive layers or between a light-sensitive layer and a protective layer, (3) an undercoat layer provided between a light-sensitive layer and a support, and (4) a back layer provided on the side opposite to the light-sensitive layer. In the light-sensitive material, a filter layer is provided as the layer (1) or (2) and an antihalation layer is provided as the layer (3) or (4).

The antihalation layer is described in JP-A-11-65021 (paragraphs 0123 to 0124), JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at the exposure wavelength. In the case where the exposure wavelength is present in the infrared region, an infrared ray-absorbing dye is used and in such a case, the dye preferably has no absorption in the visible region.

In the case of preventing the halation using a dye having absorption in the visible region, substantially no color of the dye preferably remains after the formation of an image. For this purpose, means capable of decolorizing under the action of heat at the heat development is preferably used. In particular, the light-insensitive layer is preferably rendered to function as an antihalation layer by adding thereto a thermally decolorizable dye and a base precursor. JP-A-11-231457 describes these techniques.

The amount of the decolorizable dye added is determined according to the use of the dye. In general, the decolorizable dye is used in an amount of giving an optical density (absorbance) in excess of 0.1 when measured at the intended wavelength. The optical density is preferably from 0.15 to 2, more preferably 0.2 to 1. For attaining such an optical density, the amount of the dye used is ordinarily on the order of 0.001 to 1 $g/m^2$.

By such decolorization of dye, the optical density after heat development can be reduced to 0.1 or less. Two or more decolorizable dyes may be used in combination in the thermally decolorizable recording material or heat-developable light-sensitive material. Also, two or more base precursors may be used in combination.

In the thermal decolorization using the decolorizable dye and base precursor, for example, a substance (e.g., diphenylsulfone, 4-chlorophenyl(phenyl)sulfone) capable of lowering the melting point by 3° C. or more when mixed with the base precursor, described in JP-A-11-352626, or 2-naphthylbenzoate is preferably used in combination in view of the thermal decolorizability and the like.

In the present invention, a coloring agent having an absorption maximum at 300 to 450 nm may be added for the purpose of improving silver color tone or preventing change of image in aging. Examples of such a coloring agent include those described in JP-A-62-210458, JP-A-63-104046, JP-A-63-103235, JP-A-63-208846, JP-A-63-306436, JP-A-63-314535, JP-A-01-61745 and JP-A-2001-100363. The coloring agent is usually added in the range from 0.1 $mg/m^2$ to 1 $g/m^2$ and the layer to which the coloring agent is added is preferably a back layer provided on the side opposite to the light-sensitive layer.

In the present invention, the heat-developable light-sensitive material is preferably a so-called one-sided light-sensitive material having at least one light-sensitive layer containing a silver halide emulsion on one side of the support and having a back layer on the other side.

(Description of Matting Agent)

In the present invention, a matting agent is preferably added for improving the conveyance property. Examples of the matting agent include those described in JP-A-11-65021 (paragraphs 0126 to 0127). The amount of the matting agent added is, in terms of the coated amount per $m^2$ of the light-sensitive material, preferably from 1 to 400 $mg/m^2$, more preferably from 5 to 300 $mg/m^2$. The matting agent for use in the present invention may have either a regular form or an amorphous form but preferably has a regular form and is preferably spherical. The average particle size of the matting agent is preferably from 0.5 to 10 $\mu$m, more preferably from 1.0 to 8.0 $\mu$m, still more preferably from 2.0 to 6.0 $\mu$m. The coefficient of variation in the size distribution is preferably 50% or less, more preferably 40% or less, still more preferably 30% or less. The term "coefficient of variation" as used herein means a value expressed by (standard deviation of particle size)/(average particle size)× 100. It is also preferred to use two matting agents having a small coefficient of variation and different in the average particle size by a ratio of 3 or more. The matting degree on the emulsion surface may be any value insofar as a stardust failure does not occur but is preferably, in terms of the Bekk smoothness, from 30 to 2,000 seconds, more preferably from 40 to 1,500 seconds. The Bekk smoothness can be easily determined according to Japanese Industrial Standard (JIS) P8119, "Paper and Paperboard Smoothness Testing Method by Bekk Smoothness Tester", and TAPPI Standard Method T479.

As for the matting degree of the back layer for use in the present invention, the Bekk smoothness is preferably from 10 to 1,200 seconds, more preferably from 20 to 800 seconds, still more preferably from 40 to 500 seconds. In the present invention, the matting agent is preferably incorporated into the outermost surface layer, a layer acting as the outermost surface layer, or a layer close to the outer surface, of the light-sensitive material, or is preferably incorporated into a layer acting as a protective layer.

The back layer which can be applied to the present invention is described in JP-A-11-65021 (paragraphs 0128 to 0130).

In the heat-developable light-sensitive material where the present invention is preferably used, the pH on the layer surface before heat development is preferably 7.0 or less, more preferably 6.6 or less. The lower limit thereof is not particularly limited but is about 3. The most preferred pH range is from 4 to 6.2. For adjusting the pH on the layer surface, a nonvolatile acid such as organic acid (e.g., phthalic acid derivative) or sulfuric acid, or a volatile base such as ammonia is preferably used from the standpoint of reducing the pH on the layer surface. In particular, ammonia is preferred for achieving a low layer surface pH, because ammonia is readily volatilized and can be removed in the coating step or before the heat development. Furthermore, a combination use of ammonia with a nonvolatile base such as sodium hydroxide, potassium hydroxide or lithium hydroxide is also preferred. The method of measuring the pH on the layer surface is described in JP-A-2000-284399 (paragraph 0123).

In the present invention, a hardening agent may be used for each layer such as light-sensitive layer, protective layer and back layer. Preferred examples of the hardening agent include those described in T. H. James, *The Theory of the Photographic Process*, Fourth Edition, pp. 77–87, Macmillan Publishing Co., Inc. (1977), chrome alum, 2,4-dichloro-6-hydroxy-s-triazine sodium salt, N,N-ethylenebis (vinylsulfonacetamide), N,N-propylenebis (vinylsulfonacetamide), polyvalent metal ion described in ibid., page 78, polyisocyanates described in U.S. Pat. No. 4,281,060 and JP-A-6-208193, epoxy compounds described in U.S. Pat. No. 4,791,042, and vinyl sulfone-base compounds described in JP-A-62-89048.

The hardening agent is added as a solution. The timing of adding the solution to the coating solution for protective layer is from 180 minutes before coating to immediately before coating, preferably from 60 minutes to 10 seconds before coating. The mixing method and conditions for the mixing are not particularly limited insofar as the effect of the present invention is satisfactorily brought out. Specific examples of the mixing method include a method of mixing the solutions in a tank designed to give a desired average residence time which is calculated from the addition flow rate and the amount of solutions fed to the coater, and a method of using a static mixer described, for example, in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989).

The surfactant which can be applied to the present invention is described in JP-A-11-65021 (paragraph 0132), the solvent is described in paragraph No. 0133 of the same patent publication, the support is described in paragraph No. 0134 of the same patent publication, the antistatic or electrically conducting layer is described in paragraph No. 0135 of the same patent publication, the method for obtaining a color image is described in paragraph No. 0136 of the same patent publication, and the slipping agent is described in JP-A-11-84573 (paragraphs 0061 to 0064) and JP-A-2001-83679 (paragraphs 0049 to 0062).

In the present invention, the light-sensitive material preferably has an electrically conducting layer containing a metal oxide. The electrically conducting material for the electrically conducting layer is preferably a metal oxide increased in the electrical conductivity by introducing an oxygen defect or a foreign metal atom into the metal oxide. Preferred examples of the metal oxide include ZnO, $TiO_2$ and $SnO_2$. It is preferred to add Al or In to $ZnO_2$, add Sb, Nb, P or a halogen element to $SnO_2$, and add Nb or Ta to $TiO_2$. In particular, $SnO_2$ having added thereto Sb is preferred. The amount of the foreign metal atom added is preferably from 0.01 to 30 mol %, more preferably from 0.1 to 10 mol %. The shape of the metal oxide may be any one of spherical form, needle-like form and plate-like form but in view of the effect of imparting electrical conductivity, a needle-like particle having a major axis/minor axis ratio of 2.0 or more, preferably from 3.0 to 50 is preferred. The amount of the metal oxide used is preferably from 1 to 1,000 mg/$m^2$, more preferably from 10 to 500 mg/$m^2$, still more preferably from 20 to 200 mg/$m^2$. In the present invention, the electrically conducting layer may be provided either on the emulsion surface side or on the back surface side but is preferably provided between a support and a back layer. Specific examples of the electrically conducting layer for use in the present invention include those described in JP-A-7-295146 and JP-A-11-223901.

A fluorine-containing surfactant is preferably used. Specific examples of the fluorine-containing surfactant include compounds described in JP-A-10-197985, JP-A-2000-19680 and JP-A-2000-214554. Also, a polymer fluorine-containing surfactant described in JP-A-9-281636 is preferably used. For use in the heat-developable light-sensitive material of the present invention, fluorine-containing surfactants described in JP-A-2002-82411 and Japanese Patent Application Nos. 2001-242357 and 2002-74564 are preferred. Particularly, in the case where an aqueous coating solution is used for the coating and production, fluorine-containing surfactants described in Japanese Patent Application Nos. 2001-242357 and 2002-74564 are preferred in view of charge controlling ability, stability of the coated surface and slipability, and the fluorine-containing surfactant described in Japanese Patent Application No. 2002-74564 is most preferred because the charge controlling ability is high and the amount used can be reduced. In the present invention, the fluorine-containing surfactant can be used either on the emulsion surface or on the back surface and is preferably used on both surfaces. Also, the fluorine-containing surfactant is preferably used in combination with the above-described electrically conducting layer containing a metal oxide. In this case, a sufficiently high performance can be obtained even if the amount of the fluorine-containing surfactant used on the surface having the electrically conducting layer is reduced. The amount of the fluorine-containing surfactant used is preferably, on each of the emulsion side and the back side, from 0.1 to 100 mg/m$^2$, more preferably from 0.3 to 30 mg/m$^2$, still more preferably from 1 to 10 mg/m$^2$. In particular, the fluorine-containing surfactant described in Japanese Patent Application No. 2002-74564 has a large effect and is preferably used in the range from 0.01 to 10 mg/m$^2$, more preferably from 0.1 to 5 mg/m$^2$.

The transparent support is preferably polyester, particularly polyethylene terephthalate, subjected to a heat treatment in the temperature range from 130 to 185° C. so as to relax the internal distortion remaining in the film at the biaxial stretching and thereby eliminate the occurrence of thermal shrinkage distortion during the heat development. In the case of a heat-developable light-sensitive material for medical uses, the transparent support may be colored with a blue dye (for example, Dye-1 described in Example of JP-A-8-240877) or may be colorless. For the support, a technique of undercoating, for example, a water-soluble polyester described in JP-A-11-84574, a styrene-butadiene copolymer described in JP-A-10-186565, or a vinylidene chloride copolymer described in JP-A-2000-39684 and JP-A-2001-83679 (paragraphs 0063 to 0080) is preferably applied. As for the antistatic layer or undercoating, techniques described in JP-A-56-143430, JP-A-56-143431, JP-A-58-62646, JP-A-56-120519, JP-A-11-84573 (paragraphs 0040 to 0051), U.S. Pat. No. 5,575,957 and JP-A-11-223898 (paragraphs 0078 to 0084) can be applied.

The heat-developable light-sensitive material is preferably a mono-sheet type (a type where an image can be formed on the heat-developable light-sensitive material without using another sheet such as image-receiving material).

The heat-developable light-sensitive material may further contain an antioxidant, a stabilizer, a plasticizer, an ultraviolet absorbent and a coating aid. These various additives are added to either a light-sensitive layer or a light-insensitive layer. These additives are described in WO98/36322, EP-A-803764, JP-A-10-186567 and JP-A-10-18568.

The heat-developable light-sensitive material of the present invention may be coated by any method. Specifically, various coating operations including extrusion coating, slide coating, curtain coating, dip coating, knife coating, flow coating, and extrusion coating using a hopper of the type described in U.S. Pat. No. 2,681,294 may be used. The extrusion coating or slide coating described in Stephen F. Kistler and Petert M. Schweizer, *LIQUID FILM COATING*, pp. 399–536, CHAPMAN & HALL (1977) is preferred and the slide coating is more preferred. An example of the shape of the slide coater used in the slide coating is shown in FIG. 11b.1 of ibid., page 427. If desired, two or more layers may be simultaneously coated using a method described in ibid., pp. 399–536, U.S. Pat. No. 2,761,791 and British Patent No. 837,095.

The coating solution for the organic silver salt-containing layer used in the present invention is preferably a so-called thixotropic fluid. The technique is described in JP-A-11-52509. The coating solution for the organic silver salt-containing layer used in the present invention preferably has a viscosity of 400 to 100,000 mPa·s, more preferably from 500 to 20,000 mPa·s, at a shear rate of 0.1 s$^{-1}$. At a shear rate of 1,000 s$^{-1}$, the viscosity is preferably from 1 to 200 mPa·s, more preferably from 5 to 80 mPa·s.

Examples of the technique which can be used for the heat-developable light-sensitive material of the present invention include those described in EP-A-803764, EP-A-883022, WO98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, JP-A-2000-187298, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936.

The heat-developable light-sensitive material to which the present invention is preferably applied forms a black-and-white image by a silver image and is preferably used as a heat-developable light-sensitive material for medical diagnosis, industrial photography, lithography or COM, however, the present invention is not limited thereto. Also, the present invention can be preferably used as the emulsion particularly for a high-sensitivity blue-sensitive layer of a color negative film or a color reversal film.

When the emulsion of the present invention is spectrally sensitized, the light-sensitive material of the present invention is preferably exposed with a light source having a wavelength at which the emulsion has its absorption maximum or within the range of 50 nm in the vicinity thereof.

In particular, the light-sensitive material of the present invention is preferably exposed with a blue light source having a light emission maximum in the wavelength region from 300 to 460 nm. As the exposure light source, a semiconductor laser, a diode or a solid laser is preferably used.

The present invention is described in greater detail below by referring to Examples, however, it should be understood that the present invention is not limited thereto.

EXAMPLE 1

Example of Silver Iodide Fine Particle Emulsion (Preparation of Silver Halide Emulsion)

<Preparation of Silver Halide Emulsion 1>

A solution was prepared by adding 4.1 ml of a 1 weight % potassium iodide solution to 1,421 ml of distilled water and further adding 3.5 ml of sulfuric acid in a concentration of 0.5 mol/liter and 31.7 g of phthalated gelatin and while stirring the solution in a stainless steel reaction pot and while keeping the liquid temperature at 38° C., the entire amount of Solution A prepared by diluting 22.22 g of silver nitrate with distilled water to a volume of 95.4 ml and the entire amount of Solution B prepared by diluting 21.70 g of potassium iodide with distilled water to a volume of 97.4 ml were added at a constant flow rate over 45 seconds. Thereto, 10 ml of an aqueous 3.5 weight % hydrogen peroxide solution was added and then, 10.8 ml of a 10 weight % aqueous solution of benzimidazole was further added. Thereafter, the entire amount of Solution C prepared by diluting 51.86 g of silver nitrate with distilled water to a volume of 317.5 ml and the entire amount of Solution D prepared by diluting 50.64 g of potassium iodide with distilled water to a volume of 400 ml were added. Here, Solution C was added at a constant flow rate over 20 minutes and Solution D was added by a controlled double jet method while maintaining the pAg at 8.1. After 10 minutes from the initiation of addition of Solution C and Solution D, the entire amount of potassium hexachloroiridate(III) was added in an amount of $1\times10^{-4}$ mol per mol of silver. Furthermore, 5 seconds after the completion of addition of Solution C, the entire amount of an aqueous potassium hexacyanoferrate(II) solution was added in an amount of $3\times10^{-4}$ mol per mol of silver. Then, the pH was adjusted to 3.8 using sulfuric acid in a concentration of 0.5 mol/liter and after stirring was stopped, the resulting mixture was subjected to precipitation/desalting/water washing. The pH was then adjusted to 5.9 using an aqueous sodium hydroxide solution in a concentration of 1 mol/liter, thereby preparing a silver halide dispersion having a pAg of 8.0.

While stirring the silver halide dispersion obtained above and thereby keeping it at 38° C., a methanol solution containing Spectral Sensitizing Dye A and Spectral Sensitizing Dye B at a molar ratio of 1:1 was added in an amount, as a total of Sensitizing Dye A and Sensitizing Dye B, of $7.5\times10^{-4}$ mol per form of silver, a methanol solution of 5-methyl-2-mercaptobenzimidazole was added in an amount of $1.0\times10^{-3}$ mol per mol of silver, and a methanol solution of 1-phenyl-2-heptyl-5-mercapto-1,3,4-triazole was added in an amount of $1.0\times10^{-3}$ mol per mol of silver to prepare Silver Halide Emulsion A-1. The grains in the thus-prepared silver halide emulsion were silver iodide grains having an average equivalent-sphere diameter of 0.035 μm and a coefficient of variation in the equivalent-sphere diameter of 10%. The grain size and the like were determined as an average of 1,000 grains using an electron microscope. Emulsions A-2 to A-21 were prepared by changing the grain growth temperature and electric potential at the preparation of Emulsion A-1 and further adding a compound capable of reducing the fluorescence at 38° C. to the emulsion after dispersion as shown in Table 1.

TABLE 1

| Emulsion | Growth Temperature ° C. | pAg at Growth | Grain Size, μm | Shape of Grain | Compound Added | Amount Added, mol/mol-Ag |
|---|---|---|---|---|---|---|
| A-1 | 38 | 8.1 | 0.42 | tetradecahedral | none | none |
| A-2 | " | " | " | " | Compound 1 | $1\times10^{-4}$ |
| A-3 | " | " | " | " | " | $1\times10^{-3}$ |
| A-4 | " | " | " | " | Compound 2 | $1\times10^{-3}$ |
| A-5 | " | " | " | " | " | $1\times10^{-3}$ |
| A-6 | " | " | " | " | Compound 3 | $1\times10^{-4}$ |
| A-7 | " | " | " | " | " | $1\times10^{-3}$ |
| A-8 | 30 | 7.8 | 0.28 | tetradecahedral | none | none |
| A-9 | " | " | " | " | Compound 1 | $1\times10^{-4}$ |
| A-10 | " | " | " | " | " | |
| A-11 | " | " | " | " | Compound 2 | $1\times10^{-4}$ |
| A-12 | " | " | " | " | " | $1\times10^{-3}$ |
| A-13 | " | " | " | " | Compound 3 | $1\times10^{-4}$ |
| A-14 | " | " | " | " | " | $1\times10^{-3}$ |
| A-15 | 70 | 8.8 | 0.70 | tetradecahedral/octahedral | none | none |
| A-16 | " | " | " | " | Compound 1 | $1\times10^{-4}$ |
| A-17 | " | " | " | " | " | $1\times10^{-3}$ |
| A-18 | " | " | " | " | Compound 2 | $1\times10^{-4}$ |
| A-19 | " | " | " | " | " | $1\times10^{-3}$ |
| A-20 | " | " | " | " | Compound 3 | $1\times10^{-4}$ |
| A-21 | " | " | " | " | " | $1\times10^{-3}$ |

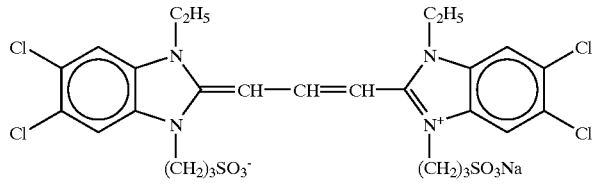

Compound 1

TABLE 1-continued

| Emulsion | Growth Temperature ° C. | pAg at Growth | Grain Size, μm | Shape of Grain | Compound Added | Amount Added, mol/mol-Ag |
|---|---|---|---|---|---|---|

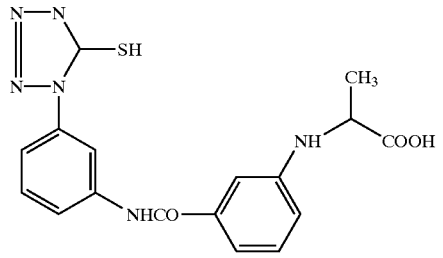

Compound 2

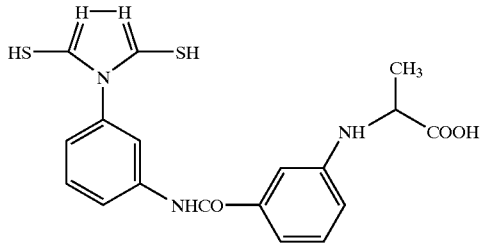

Compound 3

After undercoating gelatin on a 150 μm-thick PET base, Emulsions A-1 to A-21 thus prepared each was coated thereon to a coverage of 1.5 g/m$^2$ in terms of the coated silver amount to prepare Samples 1 to 21. Using these samples, the following sensitometry evaluation was performed.

The exposure of samples was performed by gradation exposure using a wedge through a band pass filter having a transmission maximum at 380 nm with an exposure illuminance of 1/1000 second by means of a high-illuminance exposure meter manufactured by Yamashita Denso. After the processing, the samples were measured on the density and evaluated by using, as the sensitivity, a reciprocal of the exposure amount of giving a density of fog+0.5 in black optical density. The sensitivity is shown by a relative sensitivity by taking the sensitivity of Coated Sample 1 where a compound capable of reducing fluorescence was not added as 100 for Coated Samples 1 to 7, taking the sensitivity of Coated Sample 8 where a compound capable of reducing fluorescence was not added as 100 for Coated Samples 8 to 14, and taking the sensitivity of Coated Sample 15 where a compound capable of reducing fluorescence was not added as 100 for Coated Samples 15 to 21.

(Preparation of Processing Solution)

<Chemicals Added>

| | |
|---|---|
| Sodium bisulfite | 5 g |
| Pyrogallol | 10 g |
| Sodium sulfite (SS) | 25 g |
| Sodium carbonate monohydrate (SC) | 50 g |
| KI | 0.1 g |

-continued

| | |
|---|---|
| 10% Formalin solution (containing 4% of formaldehyde) | 25.0 ml |
| Water to make | 1 liter (pH: 10.1) |

While keeping the processing solution at 38° C., development was performed over 60 minutes. After the completion of development, the film was subjected to fixing, desalting, water washing, drying and density measurement.

The fluorescence was measured by cutting the coated sample into a size of 5 mm in width and 120 mm in length and placing it in a small sample holder filled with liquid nitrogen of a spectral fluorescence photometer Model 850 manufactured by Hitachi, Ltd., which had been partially modified. Similarly to the sensitometery, the fluorescence was shown by a relative light emission intensity while taking the light emission intensity at 460 nm of Samples 1, 8 and 15 each having a common basis grain, as 100. The excited light used for the irradiation was monochromatic light at 355 nm. In the detection side, a filter of transmitting light at 400 nm or more was inserted. The measurement was performed at a sweeping rate of 60 nm/min in the wavelength range from 400 to 800 nm. Until the measurement was started, the samples were carefully prevented from being irradiated with light.

The results are shown in Table 2.

TABLE 2

| Sample | Light Emission Intensity | Sensitivity | Invention/Comparative Example |
|---|---|---|---|
| 1 | 100 | 100 | Comparative Example |
| 2 | 90 | 110 | Comparative Example |

TABLE 2-continued

| Sample | Light Emission Intensity | Sensitivity | Invention/Comparative Example |
|---|---|---|---|
| 3 | 60 | 120 | Comparative Example |
| 4 | 45 | 250 | Invention |
| 5 | 25 | 700 | Invention |
| 6 | 60 | 115 | Comparative Example |
| 7 | 40 | 300 | Invention |
| 8 | 100 | 100 | Comparative Example |
| 9 | 45 | 350 | Invention |
| 10 | 30 | 600 | Invention |
| 11 | 45 | 500 | Invention |
| 12 | 25 | 800 | Invention |
| 13 | 60 | 150 | Comparative Example |
| 14 | 25 | 800 | Invention |
| 15 | 100 | 100 | Comparative Example |
| 16 | 80 | 110 | Comparative Example |
| 17 | 60 | 120 | Comparative Example |
| 18 | 85 | 110 | Comparative Example |
| 19 | 60 | 130 | Comparative Example |
| 20 | 70 | 120 | Comparative Example |
| 21 | 40 | 400 | Invention |

As seen from Table 2, the coated samples of the present invention, where the light emission intensity is reduced to 50% or less, exhibit large sensitization.

EXAMPLE 2

Effect in Heat-Developable Light-Sensitive Material System (Preparation of PET Support)

PET having an intrinsic viscosity (IV) of 0.66 (measured at 25° C. in phenol/tetrachloroethane=6/4 (by weight)) was obtained in a usual manner using terephthalic acid and ethylene glycol. The PET was pelletized and the pellets obtained were dried at 130° C. for 4 hours, melted at 300° C., extruded from a T-die and then rapidly cooled to prepare an unstretched film having a thickness large enough to give a film thickness of 175 μm after the heat setting.

The film was stretched to 3.3 times in the machine direction using rollers different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edges of the film were knurled, and the film was wound at 4 kg/cm$^2$ to obtain a roll having a thickness of 175 μm.

(Surface Corona Treatment)

Both surfaces of the support were treated at room temperature at 20 m/min using a solid state corona treating machine Model 6 KVA manufactured by Pillar Technologies. From the current and voltage read at this time, it was known that a treatment of 0.375 kV·A·min/m$^2$ was applied to the support. The frequency at the treatment was 9.6 kHz and the gap clearance between the electrode and the dielectric roller was 1.6 mm.

(Preparation of Undercoated Support)

(1) Preparation of Coating Solution for Undercoat Layer

| | |
|---|---|
| Formulation (1) (for undercoat layer on the light-sensitive layer side): | |
| PESRESIN A-520 (30 weight % solution) produced by Takamatsu Oil & Fat Co., Ltd. | 59 g |
| Polyethylene glycol monononylphenyl ether (average ethylene oxide number: 8.5), 10 weight % solution | 5.4 g |
| MP-1000 (polymer particles, average particle size: 0.4 μm) produced by Soken Chemical & Engineering Co., Ltd. | 0.91 g |
| Distilled water | 935 ml |
| Formulation (2) (for first layer on the back surface): | |
| Styrene-butadiene copolymer latex (solid content: 40 weight %, styrene/butadiene weight ratio: 68/32) | 158 g |
| 2,4-Dichloro-6-hydroxy-S-triazine sodium salt, 8 weight % aqueous solution | 20 g |
| Sodium laurylbenzenesulfonate (1 weight % aqueous solution) | 10 ml |
| Distilled water | 854 ml |
| Formulation (3) (for second layer on the back surface): | |
| $SnO_2$/SbO (9/1 by weight, average particle size: 0.038 μm, 17 weight % dispersion) | 84 g |
| Gelatin (10 weight % aqueous solution) | 89.2 g |
| METOLOSE TC-5 produced by Shin-Etsu Chemical Co., Ltd. (2 weight % aqueous solution) | 8.6 g |
| MP-1000 produced by Soken Chemical & Engineering Co., Ltd. | 0.01 g |
| Sodium dodecylbenzenesulfonate (1 weight % aqueous solution) | 10 ml |
| NaOH (1 weight %) | 6 ml |
| PROXEL (produced by ICI) | 1 ml |
| Distilled water | 805 ml |

Both surfaces of the 175 μm-thick biaxially stretched polyethylene terephthalate support obtained above each was subjected to the above-described corona discharge treatment and on one surface (light-sensitive layer side), the undercoating solution of formulation (1) was applied by a wire bar to have a wet coated amount of 6.6 ml/m$^2$ (per one surface) and dried at 180° C. for 5 minutes. Thereafter, on the opposite surface thereof (back side), the undercoating solution of formulation (2) was applied by a wire bar to have a wet coated amount of 5.7 ml/m$^2$ and dried at 180° C. for 5 minutes. On the opposite surface (back side), the undercoating solution of formulation (3) was further applied by a wire bar to have a wet coated amount of 7.7 ml/m$^2$ and dried at 180° C. for 6 minutes, thereby obtaining an undercoated support.

(Preparation of Coating Solution on Back Side)

(Preparation of Solid Fine Particle Dispersion (a) of Base Precursor)

Base Precursor Compound 1 (1.5 kg), 225 g of surfactant (Demol N, trade name, produced by Kao Corporation), 937.5 g of diphenylsulfone and 15 g of butyl parahydroxybenzoate (Mekkins, trade name, produced by Ueno Seiyaku) were mixed and distilled water was added to make a total amount of 5.0 kg. The mixed solution was dispersed using beads in a horizontal sand mill (UVM-2, manufactured by AIMEX Co., Ltd.). More specifically, the mixed solution was fed to UVM-2 filled with zirconia beads having an average diameter of 0.5 mm by a diaphragm pump and dispersed under an internal pressure of 50 hPa or more until a desired average particle size was obtained. The dispersion was measured on the spectral absorption and dispersed until the ratio (D450/D650) of the absorbance at 450 nm to the absorbance at 650 nm in the spectral absorption of the dispersion became 2.2 or more. The obtained dispersion was diluted with distilled water to a concentration of 20 mass % in terms of the concentration of the base precursor, filtered (through a polypropylene-made filter having an average pore size of 3 μm) to remove dust and then used in practice.

(Preparation of Solid Fine Particle Dispersion of Dye)

Cyanine Dye Compound 1 (6.0 kg), 3.0 kg of sodium p-dodecylbenzenesulfonate, 0.6 kg of a surfactant Demol SNB (produced by Kao Corporation) and 0.15 kg of a defoaming agent (Surfinol 104E, trade name, produced by Nisshin Chemical Co., Ltd.) were mixed with distilled water to make a total liquid amount of 60 kg. The mixed solution was dispersed using zirconia beads of 0.5 mm in a horizontal sand mill (UVM-2, manufactured by AIMEX Co., Ltd.). The dispersion was measured on the spectral absorption and dispersed until the ratio (D650/D750) of the absorbance at 650 nm to the absorbance at 750 nm in the spectral absorption of the dispersion became 5.0 or more. The obtained dispersion was diluted with distilled water to a concentration of 6 weight % of the cyanine dye, filtered (average pore size: 1 μm) to remove dust and then used in practice.

(Preparation of Coating Solution for Antihalation Layer)

Gelatin (30 g), 24.5 g of polyacrylamide, 2.2 g of 1 mol/liter caustic soda, 2.4 g of monodisperse polymethyl methacrylate fine particles (average particle size: 8 μm, standard deviation of particle size: 0.4), 0.08 g of benzoisothiazolinone, 35.9 g of the solid fine particle dispersion of dye obtained above, 74.2 g of Solid Fine Particle Dispersion (a) of base precursor obtained above, 0.6 g of sodium polystyrenesulfonate, 0.21 g of Blue Dye Compound 1, 0.15 g of Yellow Dye Compound 1 and 8.3 g of an acrylic acid/ethyl acrylate copolymer latex (copolymerization weight ratio: 5/95) were mixed and water was added to make a total of 8,183 ml, thereby preparing a coating solution for antihalation layer.

(Preparation of Coating Solution for Protective Layer on Back Side)

In a container kept at 40° C., 40 g of gelatin, 1.5 g (as liquid paraffin) of liquid paraffin emulsion, 35 mg of benzoisothiazolinone, 6.8 g of 1 mol/liter caustic soda, 0.5 g of sodium tert-octylphenoxyethoxyethanesulfonate, 0.27 g of sodium polystyrenesulfonate, 37 mg of Fluorine-Containing Surfactant (F-1) (N-perfluorooctylsulfonyl-N-propylalanine potassium salt), 150 m g of Fluorine-Containing Surfactant (F-2) (polyethylene glycol mono(N-perfluorooctylsulfonyl-N-propyl-2-aminoethyl) ether [ethylene oxide average polymerization degree: 15]), 64 mg of a fluorine-containing surfactant (F-3), 32 mg of Fluorine-Containing Surfactant (F-4), 6.0 g of an acrylic acid/ethyl acrylate copolymer (copolymerization mass ratio: 5/95) and 2.0 g of N,N-ethylenebis(vinylsulfonacetamide) were mixed and water was added to make 10 liter, thereby preparing a coating solution for protective layer on the back side.

<Preparation of Mixed Emulsion A for Coating Solution>

Silver Halide Emulsion A-1 (70 weight %), 15 weight % of Silver Halide Emulsion A-8 and 15 weight % of Silver Halide Emulsion A-15 each prepared in Example 1 were dissolved and thereto, a 1 mass % aqueous solution of benzothiazolium iodide was added in an amount of $7\times10^{-3}$ mol per mol of silver. Furthermore, water was added to adjust the silver halide content to 38.2 g in terms of silver per kg of the mixed emulsion for coating solution.

(Preparation of Fatty Acid Silver Salt Dispersion A)

Behenic acid (87.6 kg, Edenor C22-85R, product name, produced by Henkel Co.), 423 liter of distilled water, 49.2 liter of an aqueous NaOH solution in a concentration of 5 mol/liter, and 120 liter of tert-butyl alcohol were mixed. The mixture was reacted by stirring at 75° C. for one hour to obtain Sodium Behenate Solution A. Separately, 206.2 liter (pH 4.0) of an aqueous solution containing 40.4 kg of silver nitrate was prepared and kept at 10° C. A reactor containing 635 liter of distilled water and 30 liter of tert-butyl alcohol was kept at 30° C. and while thoroughly stirring, the entire amount of Sodium Behenate Solution A obtained above and the entire amount of the aqueous silver nitrate solution prepared above were added at a constant flow rate over 93 minutes and 15 seconds and over 90 minutes, respectively. At this time, only the aqueous silver nitrate solution was added for the period of 11 minutes after the initiation of addition of the aqueous silver nitrate solution, then addition of Sodium Behenate Solution A was started, and only Sodium Behenate Solution A was added for the period of 14 minutes and 15 second after the completion of addition of the aqueous silver nitrate solution. During the addition, the temperature inside the reactor was kept at 30° C. and the outer temperature was controlled to make constant the liquid temperature. The piping in the system of adding Sodium Behenate Solution A was kept warm by circulating hot water in the outer side of a double pipe, whereby the outlet liquid temperature at the end of the addition nozzle was adjusted to 75° C. The temperature of piping in the system of adding the aqueous silver nitrate solution was kept by circulating cold water in the outer side of a double pipe. The addition site of Sodium Behenate Solution A and the addition site of aqueous silver nitrate solution were symmetrically arranged with the center on the stirring axis. Also, these addition sites were each adjusted to a height of not causing contact with the reaction solution.

After the completion of addition of Sodium Behenate Solution A, the mixture was left standing at the same temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was evaluated by electron microphotography, as a result, the grains were scaly crystals having average dimensions of 0.14 μm×0.4 μm×0.6 μm, an average aspect ratio of 5.2, an average equivalent-sphere diameter of 0.52 μm and a coefficient of variation in the equivalent-sphere diameter of 15%.

To the wet cake corresponding to 260 kg as a dry solid content, 19.3 kg of polyvinyl alcohol (PVA-217, trade name) and water were added to make a total amount of 1,000 kg. The resulting mixture was formed into a slurry by a dissolver blade and the slurry was preliminarily dispersed by a pipeline mixer (Model PM-10, manufactured by Mizuho Industrial Co., Ltd.).

Then, the preliminarily dispersed stock solution was treated three times in a dispersing machine (Microfluidizer M-610, trade name, manufactured by Microfluidex International Corporation, using a Z-type interaction chamber) under the control of pressure to 1,260 kg/cm$^2$ to obtain a silver behenate dispersion. At the dispersion, the temperature was set to 18° C. by a cooling operation of controlling the coolant temperature using coiled heat exchangers attached to the inlet side and outlet side of the interaction chamber.

<Preparation of Fatty Acid Silver Salt Dispersion B>

(Preparation of Recrystallized Behenic Acid)

Behenic acid (100 kg, Edenor C22-85R, product name, produced by Henkel Co.) was mixed with 1,200 kg of isopropyl alcohol and the mixture was dissolved at 50° C. and filtered through a filter of 10 μm. Thereafter, the filtrate was cooled to 30° C. and recrystallized. At the recrystallization, the cooling speed was controlled to 3° C./hour. The obtained crystals were filtered by centrifugation, washed by pouring 100 kg of isopropyl alcohol thereon and then dried. The resulting crystals were esterified and analyzed by GC-FID, as a result, the behenic acid content was 96% and other than this, 2% of lignoceric acid and 2% of arachidic acid were contained.

(Preparation of Fatty Acid Silver Salt Dispersion B)

The recrystallized behenic acid (88 kg), 422 liter of distilled water, 49.2 liter of an aqueous NaOH solution in a concentration of 5 mol/liter, and 120 liter of tert-butyl alcohol were mixed. The mixture was reacted by stirring at 75° C. for one hour to obtain Sodium Behenate Solution B. Separately, 206.2 liter (pH 4.0) of an aqueous solution containing 40.4 kg of silver nitrate was prepared and kept at 10° C. A reactor containing 635 liter of distilled water and 30 liter of tert-butyl alcohol was kept at 30° C. and while thoroughly stirring, the entire amount of Sodium Behenate Solution B obtained above and the entire amount of the aqueous silver nitrate solution prepared above were added at a constant flow rate over 93 minutes and 15 seconds and over 90 minutes, respectively. At this time, only the aqueous silver nitrate solution was added for the period of 11 minutes after the initiation of addition of the aqueous silver nitrate solution, then addition of Sodium Behenate Solution B was started, and only Sodium Behenate Solution B was added for the period of 14 minutes and 15 second after the completion of addition of the aqueous silver nitrate solution. During the addition, the temperature inside the reactor was kept at 30° C. and the outer temperature was controlled to make constant the liquid temperature. The piping in the system of adding Sodium Behenate Solution B was kept warm by circulating hot water in the outer side of a double pipe, whereby the outlet liquid temperature at the distal end of the addition nozzle was adjusted to 75° C. The temperature of piping in the system of adding the aqueous silver nitrate solution was kept by circulating cold water in the outer side of a double pipe. The addition site of Sodium Behenate Solution B and the addition site of aqueous silver nitrate solution were symmetrically arranged with the center on the stirring axis. Also, these addition sites were each adjusted to a height of not causing contact with the reaction solution.

After the completion of addition of Sodium Behenate Solution B, the mixture was left standing at the same temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was evaluated by electron microphotography, as a result, the grains were scaly crystals having average dimensions of 0.21 μm×0.4 μm×0.4 μm, an average aspect ratio of 2.1, an average equivalent-sphere diameter of 0.51 μm and a coefficient of variation in the equivalent-sphere diameter of 11%.

To the wet cake corresponding to 260 kg as a dry solid content, 19.3 kg of polyvinyl alcohol (PVA-217, trade name) and water were added to make a total amount of 1,000 kg. The resulting mixture was formed into a slurry by a dissolver blade and the slurry was preliminarily dispersed by a pipeline mixer (Model PM-10, manufactured by Mizuho Industrial Co., Ltd.).

Then, the preliminarily dispersed stock solution was treated three times in a dispersing machine (Microfluidizer M-610, trade name, manufactured by Microfluidex International Corporation, using a Z-type interaction chamber) under the control of pressure to 1,150 kg/cm$^2$ to obtain a silver behenate dispersion. At the dispersion, the temperature was set to 18° C. by a cooling operation of controlling the coolant temperature using coiled heat exchangers attached to the inlet side and outlet side of the interaction chamber.

(Preparation of Reducing Agent Dispersion)

<Preparation of Reducing Agent Complex 1 Dispersion>

Water (10 kg) was added to 10 kg of Reducing Agent Complex 1 (a 1:1 complex of 6,6'-di-tert-butyl-4,4'-dimethyl-2,2'-butylidenediphenol and triphenylphosphine oxide), 0.12 kg of triphenylphosphine oxide and 16 kg of a 10 weight % aqueous solution of modified polyvinyl alcohol (Poval MP203, produced by Kuraray Co., Ltd.) and thoroughly mixed to form a slurry. The slurry was transferred by a diaphragm pump to a horizontal sand mill (UVM-2, manufactured by AIMEX Co., Ltd.) filled with zirconia beads having an average diameter of 0.5 mm, and dispersed for 4 hours and 30 minutes. Thereafter, 0.2 g of benzoisothiazolinone sodium salt and water were added to adjust the reducing agent complex concentration to 22 weight %, thereby obtaining Reducing Agent Complex 1 Dispersion. The reducing agent complex particles contained in the thus-obtained reducing agent complex dispersion had a median diameter of 0.45 μm and a maximum particle size of 1.4 μm or less. The obtained reducing agent complex dispersion was filtered through a polypropylene filter having a pore size of 3.0 μm to remove foreign matters such as dust and then stored.

<Preparation of Reducing Agent 2 Dispersion>

Water (10 kg) was added to 10 kg of Reducing Agent 2 (6,6'-di-tert-butyl-4,4'-dimethyl-2,2'-butylidenediphenol) and 16 kg of a 10 weight % aqueous solution of modified polyvinyl alcohol (Poval MP203, produced by Kuraray Co., Ltd.) and thoroughly mixed to form a slurry. The slurry was transferred by a diaphragm pump to a horizontal sand mill (UVM-2, manufactured by AIMEX Co, Ltd.) filled with zirconia beads having an average diameter of 0.5 mm, and dispersed for 3 hours and 30 minutes. Thereafter, 0.2 g of benzoisothiazolinone sodium salt and water were added to adjust the reducing agent concentration to 25 weight %. The dispersion solution was heat-treated at 60° C. for 5 hours to obtain Reducing Agent 2 Dispersion. The reducing agent particles contained in the thus-obtained reducing agent dispersion had a median diameter of 0.40 μm and a maximum particle size of 1.5 μm or less. The obtained reducing agent dispersion was filtered through a polypropylene filter having a pore size of 3.0 μm to remove foreign matters such as dust and then stored.

<Preparation of Hydrogen Bond-Forming Compound 1 Dispersion>

Water (10 kg) was added to 10 kg of Hydrogen Bond-Forming Compound 1 (tri(4-tert-butylphenyl)phosphine oxide) and 16 kg of a 10 weight % aqueous solution of modified polyvinyl alcohol (Poval MP203, produced by Kuraray Co., Ltd.) and thoroughly mixed to form a slurry. The resulting slurry was transferred by a diaphragm pump to a horizontal sand mill (UVM-2, manufactured by AIMEX Co., Ltd.) filled with zirconia beads having an average diameter of 0.5 mm, and dispersed for 3 hours and 30 minutes. Thereafter, 0.2 g of benzoisothiazolinone sodium salt and water were added to adjust the hydrogen bond-forming compound concentration to 25 weight %. The dispersion was heated at 80° C. for one hour to obtain Hydrogen Bond-Forming Compound 1 Dispersion. The hydrogen bond-forming compound particles contained in the thus-obtained hydrogen bond-forming compound dispersion had a median diameter of 0.35 μm and a maximum particle size of 1.5 μm or less. The obtained hydrogen bond-forming compound dispersion was filtered through a polypropylene filter having a pore size of 3.0 μm to remove foreign matters such as dust and then stored.

<Preparation of Development Accelerator 1 Dispersion>

Water (10 kg) was added to 10 kg of Development Accelerator 1 and 20 kg of a 10 weight % aqueous solution of modified polyvinyl alcohol (Poval MP203, produced by Kuraray Co., Ltd.) and thoroughly mixed to form a slurry. The resulting slurry was transferred by a diaphragm pump to a horizontal sand mill (UVM-2, manufactured by AIMEX Co., Ltd.) filled with zirconia beads having an average diameter of 0.5 mm, and dispersed for 3 hours and 30 minutes. Thereafter, 0.2 g of benzoisothiazolinone sodium salt and water were added to adjust the development accelerator concentration to 20 weight %, thereby obtaining Development Accelerator 1 Dispersion. The development accelerator particles contained in the thus-obtained development accelerator dispersion had a median diameter of 0.48 μm and a maximum particle size of 1.4 μm or less. The obtained development accelerator dispersion was filtered through a polypropylene filter having a pore size of 3.0 μm to remove foreign matters such as dust and then stored.

Solid Dispersions of Development Accelerator 2, Development Accelerator 3 and Color Tone Adjusting Agent 1 each was obtained as a 20 weight % dispersion in the same manner as Development Accelerator 1.

(Preparation of Polyhalogen Compound Dispersion)

<Preparation of Organic Polyhalogen Compound 1 Dispersion>

10 kg of Organic Polyhalogen Compound 1 (tribromomethanesulfonylbenzene), 10 kg of a 20 weight % aqueous solution of modified polyvinyl alcohol (Poval MP203, produced by Kuraray Co., Ltd.), 0.4 kg of a 20 weight % aqueous solution of sodium triisopropylnaphthalenesulfonate and 14 kg of water were added and thoroughly mixed to form a slurry. The resulting slurry was transferred by a diaphragm pump to a horizontal sand mill (UVM-2, manufactured by AIMEX Co., Ltd.) filled with zirconia beads having an average diameter of 0.5 mm, and dispersed for 5 hours. Thereafter, 0.2 g of benzoisothiazolinone sodium salt and water were added to adjust the organic polyhalogen compound concentration to 26 weight %, thereby obtaining Organic Polyhalogen Compound 1 Dispersion. The organic polyhalogen compound particles contained in the thus-obtained polyhalogen compound dispersion had a median diameter of 0.41 μm and a maximum particle size of 2.0 μm or less. The obtained organic polyhalogen compound dispersion was filtered through a polypropylene filter having a pore size of 10.0 μm to remove foreign matters such as dust and then stored.

<Preparation of Organic Polyhalogen Compound 2 Dispersion>

Organic Polyhalogen Compound 2 (N-butyl-3-tribromomethanesulfonylbenzamide) (10 kg), 20 kg of a 10 weight % aqueous solution of modified polyvinyl alcohol (Poval MP203, produced by Kuraray Co., Ltd.) and 0.4 kg of a 20 weight % aqueous solution of sodium triisopropylnaphthalenesulfonate were added and thoroughly mixed to form a slurry. The resulting slurry was transferred by a diaphragm pump to a horizontal sand mill (UVM-2, manufactured by AIMEX K.K.) filled with zirconia beads having an average diameter of 0.5 mm, and dispersed for 5 hours. Thereafter, 0.2 g of benzoisothiazolinone sodium salt and water were added to adjust the organic polyhalogen compound concentration to 30 weight %. The dispersion solution was heated at 40° C. for 5 hours to obtain Organic Polyhalogen Compound 2 Dispersion. The organic polyhalogen compound particles contained in the thus-obtained polyhalogen compound dispersion had a median diameter of 0.40 μm and a maximum particle size of 1.3 μm or less. The obtained organic polyhalogen compound dispersion was filtered through a polypropylene filter having a pore size of 3.0 μm to remove foreign matters such as dust and then stored.

<Preparation of Phthalazine Compound 1 Solution>

In 174.57 kg of water, 8 kg of modified polyvinyl alcohol MP203 produced by Kuraray Co., Ltd. was dissolved. Thereto, 3.15 kg of a 20 weight % aqueous solution of sodium triisopropylnaphthalenesulfonate and 14.28 kg of a 70 weight % aqueous solution of Phthalazine Compound 1 (6-isopropylphthalazine) were added to prepare a 5 weight % solution of Phthalazine Compound 1.

(Preparation of Mercapto Compound Solution)

<Preparation of Aqueous Mercapto Compound 1 Solution>

In 993 g of water, 7 g of Mercapto Compound 1 (1-(3-sulfophenyl)-5-mercaptotetrazole sodium salt) was dissolved to prepare a 0.7 weight % aqueous solution.

<Preparation of Aqueous Mercapto Compound 2 Solution>

In 980 g of water, 20 g of Mercapto Compound 2 (1-(3-methylureido)-5-mercaptotetrazole sodium salt) was dissolved to prepare a 2.0 weight % aqueous solution.

<Preparation of Pigment 1 Dispersion>

Water (250 g) was added to 64 g of C.I. Pigment Blue 60 and 6.4 g of Demol N (produced by Kao Corporation) and thoroughly mixed to form a slurry. The resulting slurry and 800 g of zirconia beads having an average diameter of 0.5 mm were put together into a vessel and dispersed for 25 hours in a dispersing machine (¼G Sand Grinder Mill, manufactured by AIMEX Co., Ltd.) to obtain Pigment 1 Dispersion. The pigment particles contained in the thus-obtained pigment dispersion had an average particle size of 0.21 μm.

<Preparation of SBR Latex Solution>

An SBR latex having a Tg of 22° C. was prepared as follows.

Using ammonium persulfate as a polymerization initiator and an anionic surfactant as an emulsifier, 70.0 parts by weight of styrene, 27.0 parts by weight of butadiene and 3.0 parts by weight of acrylic acid were emulsion-polymerized. After aging at 80° C. for 8 hours, the resulting polymer was cooled to 40° C. and adjusted to a pH of 7.0 with aqueous ammonia. Thereto, SANDET BL (produced by Sanyo Chemical Industries, Ltd.) was added to have a concentration of 0.22%. Thereafter, the pH was adjusted to 8.3 by adding an aqueous 5% sodium hydroxide solution further adjusted to 8.4 with aqueous ammonia. The molar ratio of $Na^+$ ion and $NH_4$+ion used was 1:2.3. Per 1 kg of the resulting solution, 0.15 ml of a 7% aqueous solution of benzoisothiazolinone sodium salt was added to prepare an SBR latex solution.

SBR Latex: latex of -St(70.0)-Bu(27.0)-AA(3.0)-)

Tg: 22° C.

Average particle size: 0.1 μm, concentration: 43 weight %, equilibrium moisture content at 25° C. and 60% RH: 0.6 weight %, ion conductivity: 4.2 mS/cm (in the measurement of ion conductivity, the latex stock solution (43 weight %) was measured at 25° C. using a conductivity meter CM-30S manufactured by DKK-TOA CORPORATION), pH: 8.4.

SBR latexes different in the Tg can be prepared in the same manner by appropriately changing the ratio of styrene and butadiene.

<Preparation of Coating Solution 1 for Emulsion Layer (Light-Sensitive Layer)>

The fatty acid silver salt dispersion (1,000 g, a 1:1 mixture of A and B prepared above), 276 ml of water, 33.2 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of the SBR latex (Tg: 22° C.) solution, 299 g of Reducing Agent Complex 1 Dispersion, 6 g of Development Accelerator 1 Dispersion, 9 ml of Aqueous Mercapto Compound 1 Solution and 27 ml of Aqueous Mercapto Compound 2 Solution were sequentially added. Immediately before the coating, 117 g of Mixed Emulsion A for Coating Solution was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K.K. and found to be 25 [mPa·s] at 40° C. (No. 1 rotor, 60 rpm).

The viscosity of the coating solution measured at 25° C. using RFS Fluid Spectrometer (manufactured by Rheometrics Fareast Co., Ltd.) was 230, 60, 46, 24 and 18 [mPa·s] at a shear rate of 0.1, 1, 10, 100 and 1,000 [1/sec], respectively. The amount of zirconium in the coating solution was 0.38 mg per g of silver.

<Preparation of Coating Solution 2 for Emulsion Layer (Light-Sensitive Layer)>

The fatty acid silver salt dispersion (1,000 g, a 1:1 mixture of A and B prepared above), 276 ml of water, 32.8 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of the SBR latex (Tg: 20° C.) solution, 155 g of Reducing Agent 2 Dispersion, 55 g of Hydrogen Bond-Forming Compound 1 Dispersion, 6 g of Development Accelerator 1 Dispersion, 2 g of Development Accelerator 2 Dispersion, 3 g of Development Accelerator 3 Dispersion, 2 g of Color Tone Adjusting Agent 1 Dispersion and 6 ml of Aqueous Mercapto Compound 2 Solution were sequentially added. Immediately before the coating, 117 g of the silver halide mixed emulsion (an equivalent mixture of Emulsions A-5, A-10 and A-21) of the present invention prepared in Example 1 was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K.K. and found to be 40 [mPa·s] at 40° C. (No. 1 rotor, 60 rpm).

The viscosity of the coating solution measured at 25° C. using RFS Fluid Spectrometer (manufactured by Rheometrics Fareast Co., Ltd.) was 530, 144, 96, 51 and 28 [mPa·s] at a shear rate of 0.1, 1, 10, 100 and 1,000 [1/sec], respectively. The amount of zirconium in the coating solution was 0.25 mg per g of silver.

<Preparation of Coating Solution for Interlayer on Emulsion Side>

A 5 weight % aqueous solution (27 ml) of Aerosol OT (produced by American Cyanamid Co.), 135 ml of a 20 weight % aqueous solution of diammonium phthalate and water for making a total amount of 10,000 g were added to 1,000 g of polyvinyl alcohol PVA-205 (produced by Kuraray Co., Ltd.), 272 g of a 5 weight % dispersion of pigment and 4,200 ml of a 19 weight % latex of methyl methacrylate/styrene/butyl acrylate/hydroxyethyl methacrylate/acrylic acid copolymer (copolymerization weight ratio: 64/9/20/5/2). The pH was adjusted to 7.5 with NaOH to prepare a coating solution for interlayer and then the coating solution for interlayer was transferred to a coating die to give a coverage of 9.1 ml/m$^2$. The viscosity of the coating solution was measured at 40° C. by a Brookfield viscometer (No. 1 rotor, 60 rpm) and found to be 58 [mPa·s].

<Preparation of Coating Solution for First Protective Layer on Emulsion Side>

In water, 64 g of inert gelatin was dissolved. Thereto, 80 g of a 27.5 weight % latex of methyl methacrylate/styrene/butyl acrylate/hydroxyethyl methacrylate/acrylic acid copolymer (copolymerization weight ratio: 64/9/20/5/2), 23 ml of a 10 weight % methanol solution of phthalic acid, 23 ml of a 10 weight % aqueous solution of 4-methylphthalic acid, 28 ml of sulfuric acid in a concentration of 0.5 mol/liter, 5 ml of a 5 weight % aqueous solution of Aerosol OT (produced by American Cyanamid Co.), 0.5 g of phenoxyethanol, 0.1 g of benzoisothiazolinone and water for making a total amount of 750 g were added to prepare a coating solution. Immediately before the coating, 26 ml of a 4 weight % aqueous solution of chrome alum was mixed using a static mixer. Then, the coating solution was transferred to a coating die to give a coverage of 18.6 ml/m$^2$. The viscosity of the coating solution was measured at 40° C. by a Brookfield viscometer (No. 1 rotor, 60 rpm) and found to be 20 [mPa·s].

<Preparation of Coating Solution for Second Protective Layer on Emulsion Side>

In water, 80 g of inert gelatin was dissolved. Thereto, 102 g of a 27.5 weight % latex of methyl methacrylate/styrene/butyl acrylate/hydroxyethyl methacrylate/acrylic acid copolymer (copolymerization weight ratio: 64/9/20/5/2), 3.2 ml of a 5 weight % solution of Fluorine-Containing Surfactant (F-1) (N-perfluorooctylsulfonyl-N-propylalanine potassium salt), 32 ml of a 2 weight % aqueous solution of Fluorine-Containing Surfactant (F-2) (polyethylene glycol mono(N-perfluorooctylsulfonyl-N-propyl-2-aminoethyl) ether [ethylene oxide average polymerization degree: 15]), 23 ml of a 5 weight % solution of Aerosol OT (produced by American Cyanamid Co.), 4 g of polymethyl methacrylate fine particles (average particle size: 0.7 $\mu$m), 21 g of polymethyl methacrylate fine particles (average particle size: 4.5 $\mu$m), 1.6 g of 4-methylphthalic acid, 4.8 g of phthalic acid, 44 ml of sulfuric acid in a concentration of 0.5 mol/liter, 10 mg of benzoisothiazolinone and water for making a total amount of 650 g were added. Immediately before the coating, 445 ml of an aqueous solution containing 4 weight % of chrome alum and 0.67 weight % of phthalic acid was mixed using a static mixer to obtain a coating solution for surface protective layer and then the coating solution for surface protective layer was transferred to a coating die to give a coverage of 8.3 ml/m$^2$. The viscosity of the coating solution was measured at 40° C. by a Brookfield viscometer (No. 1 rotor, 60 rpm) and found to be 19 [mPa·s].

<Preparation of Heat-Developable Light-Sensitive Material 1>

On the back surface side of the undercoated support prepared above, the coating solution for antihalation layer and the coating solution for back surface protective layer were simultaneously coated one on another to give a coated gelatin amount of 0.44 g/m$^2$ and 1.7 g/m$^2$, respectively, and then dried to form a back layer.

On the surface opposite the back surface, an emulsion layer (using Coating Solution 1 for Emulsion Layer), an interlayer, a first protective layer and a second protective layer were simultaneously coated one on another in this order from the undercoated surface by the slide bead coating method to prepare a heat-developable light-sensitive material. At this time, the temperature was adjusted such that the emulsion layer and the interlayer were 31° C., the first protective layer was 36° C. and the second protective layer was 37° C. The coated amount (g/m$^2$) of each compound in the emulsion layer was as follows.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.97 |
| Reducing Agent Complex 1 | 1.41 |
| Development Accelerator 1 | 0.024 |
| Mercapto Compound 1 | 0.002 |
| Mercapto Compound 2 | 0.012 |
| Silver halide (as Ag) | 0.091 |

The coating and drying conditions were as follows.

The coating was performed at a speed of 160 m/min, the clearance between the tip of coating die and the support was set to from 0.10 to 0.30 mm, and the pressure in the vacuum chamber was set lower by 196 to 882 Pa than the atmospheric pressure. The support was destaticized by ionized wind before the coating. In the subsequent chilling zone, the coating solution was cooled with air at a dry bulb temperature of 10 to 20° C. Thereafter, the light-sensitive material was transported by contact-free transportation and in a helical floating-type dryer, dried with drying air at a dry bulb temperature of 23 to 45° C. and a wet bulb temperature of 15 to 21° C. After drying, the humidity was adjusted to 40 to 60% RH at 25° C. and then, the layer surface was heated to 70 to 90° C. The heated layer surface was then cooled to 25° C.

The heat-developable light-sensitive material thus prepared had a matting degree of, in terms of the Bekk smoothness, 550 seconds on the light-sensitive layer surface and 130 seconds on the back surface. Furthermore, the pH on the surface of the light-sensitive layer was measured and found to be 6.0.

<Preparation of Heat-Developable Light-Sensitive Material 2>

Heat-Developable Light-sensitive Material 2 was prepared in the same manner as Heat-Developable Light-sensitive Material 1 except that in the preparation of Heat-Developable Light-sensitive Material 1, Coating Solution 1 for Emulsion Layer was changed to Coating Solution 2 for Emulsion Layer, Yellow Dye Compound 1 was eliminated from the antihalation layer, and Fluorine-Containing Surfactants F-1, F-2, F-3 and F-4 in the back surface protective layer and emulsion surface protective layer were changed to F-5, F-6, F-7 and F-8, respectively. The coated amount (g/m$^2$) of each compound in this emulsion layer was as follows.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.67 |
| Reducing Agent 2 | 0.81 |
| Hydrogen Bond-Forming Compound 1 | 0.30 |
| Development Accelerator 1 | 0.024 |
| Development Accelerator 2 | 0.010 |
| Development Accelerator 3 | 0.015 |
| Color Tone Adjusting Agent 1 | 0.010 |
| Mercapto Compound 2 | 0.002 |
| Silver halide (as Ag) | 0.091 |

Chemical structures of the compounds used in Example are shown below.

Spectral Sensitizing Dye A:

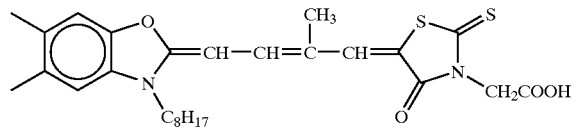

Spectral Sensitizing Dye B:

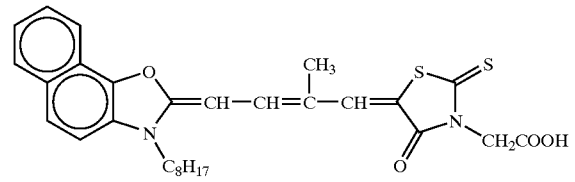

Base Precursor Compound 1:

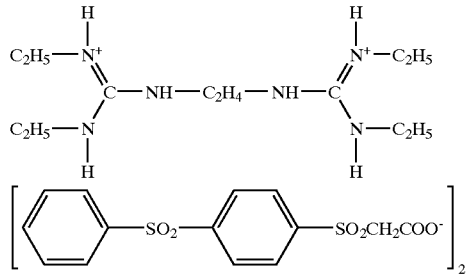

Cyanine Dye Compound 1:

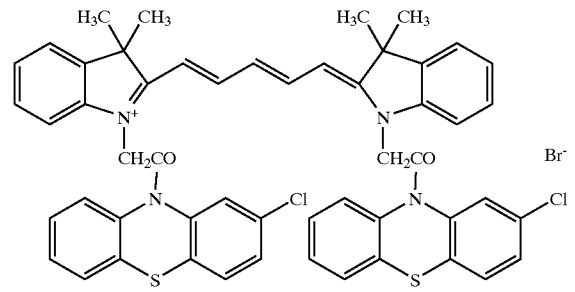

Blue Dye Compound-1:
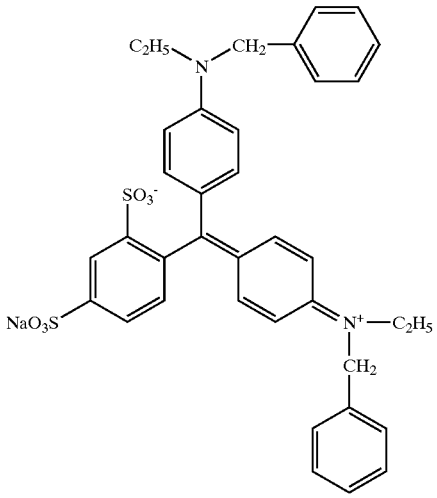
Yellow Dye Compound 1:
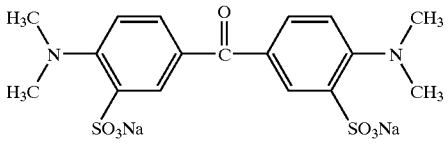
Reducing Agent Complex 1:
A 1:1 complex of
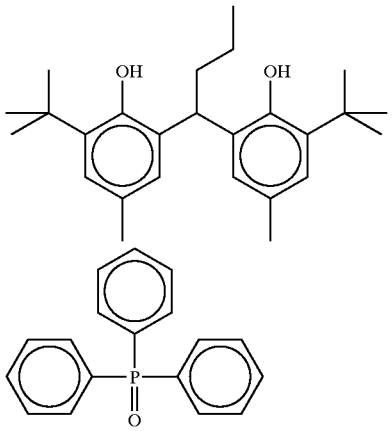
and
Reducing Agent 2:
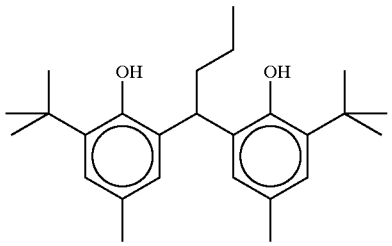
Hydrogen Bond-Forming Compound 1:
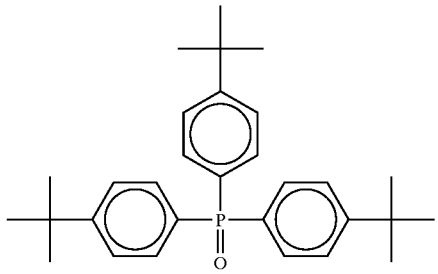
Polyhalogen Compound 1:
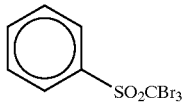
Polyhalogen Compound 2:
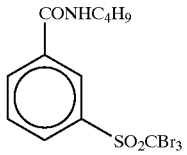
Mercapto Compound 1:
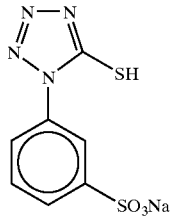
Mercapto Compound 2:
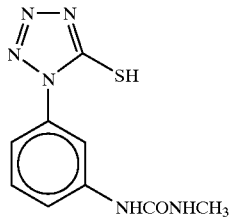
Phthalazine Compound 1:
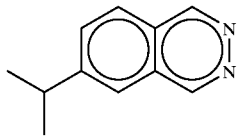

Development Accelerator 1:

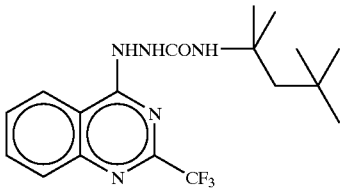

Development Accelerator 2:

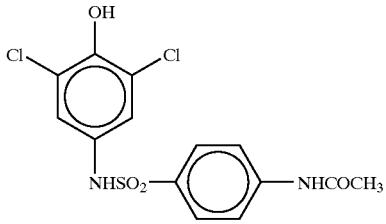

Development Accelerator 3:

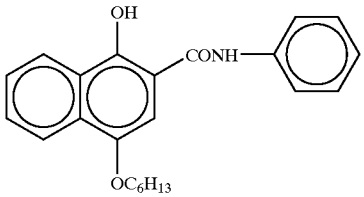

Color Tone Adjusting Agent 1:

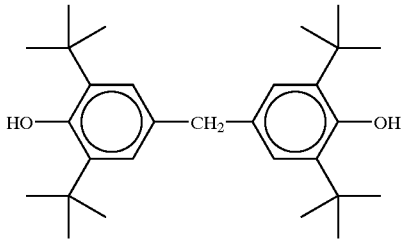

(F-1)

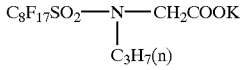

(F-2)

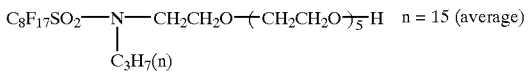

(F-3)

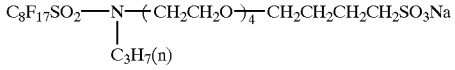

(F-4)

$C_8F_{17}SO_3K$ (F-5)

$CF_3(CF_2)_nCH_2CH_2SCH_2CH_2COOLi$ a mixture of n = 5 to 11

(F-6)

$CF_3(CF_2)_nCH_2CH_2O(CH_2CH_2O)_mH$ a mixture of n = 5 to 11, m = 5 to 15

-continued (F-7)

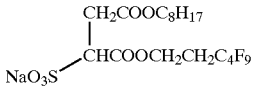

(F-8)

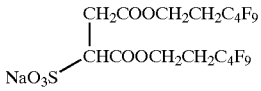

(Evaluation of Photographic Performance)

The light-sensitive materials obtained each was cut into a size of 356×432 mm, wrapped with the following packaging material in the environment of 25° C. and 50% RH, stored at an ordinary temperature for 2 weeks and then evaluated as follows.

(Packaging Material)

A laminate of PET (10 μm)/PE (12 μm)/Aluminum foil (9 μm)/Ny (15 μm)/Polyethylene containing 3% carbon black (50 μm)

Oxygen permeability: 0.02 ml/atm·$m^2$·25° C.·day

Water permeability: 0.10 g/atm·$m^2$·25° C.·day

The samples were exposed using Fuji Medical Dry Laser Imager FM-DP L (equipped with 660 nm semiconductor laser having a maximum output of 60 mW (IIIB)) or an imager produced by modifying the above imager with installing a blue semiconductor laser having a maximum exposure wavelength at 405 nm manufactured by NICHIA CORPORATION. Subsequently, the light-sensitive materials were heat-developed (with four plates of panel heater set at 112° C.–119° C.–121° C.–121° C., for 24 seconds in total in the case of Heat-Developable Light-sensitive Material 1 and for 14 seconds in total in the case of Heat-Developable Light-sensitive Material 2). The obtained image was evaluated by a densitometer. As a result, it was found that, similarly to Example 1, the light-sensitive material comprising a high iodide silver halide emulsion of the present invention exhibits high sensitivity.

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising a silver halide grain having a high silver iodide-containing phase, the surface of the silver halide grain being adsorbed with a substance capable of reducing by 50% or more the light emission intensity at 460 nm attributable to the high silver iodide-containing phase at 77° K.

2. The silver halide emulsion as claimed in claim 1, wherein the grain surface is adsorbed with an adsorbing substance capable of reducing by 70% or more the light emission intensity at 460 nm.

3. The silver halide emulsion as claimed in claim 1, wherein a silver iodide content of the high silver iodide-containing phase is 93 mol % or more.

4. The silver halide emulsion as claimed in claim 1, wherein the silver halide grain comprises a hexacyano metal complex.

5. A silver halide photographic light-sensitive material comprising the silver halide emulsion as claimed in claim 1.

6. A heat-developable photographic light-sensitive material comprising the silver halide emulsion as claimed in claim 1.

* * * * *